US012065274B2

(12) United States Patent
Kenney

(10) Patent No.: US 12,065,274 B2
(45) Date of Patent: Aug. 20, 2024

(54) BANDING OF OBJECTS WITH TAPE

(71) Applicant: Jason Kenney, Madison, WI (US)

(72) Inventor: Jason Kenney, Madison, WI (US)

( * ) Notice: Subject to any disclaimer, the term of this patent is extended or adjusted under 35 U.S.C. 154(b) by 574 days.

(21) Appl. No.: 17/271,023

(22) PCT Filed: Sep. 30, 2019

(86) PCT No.: PCT/IB2019/058301
§ 371 (c)(1),
(2) Date: Feb. 24, 2021

(87) PCT Pub. No.: WO2020/065634
PCT Pub. Date: Apr. 2, 2020

(65) Prior Publication Data

US 2021/0179301 A1 Jun. 17, 2021

Related U.S. Application Data

(60) Provisional application No. 62/738,039, filed on Sep. 28, 2018.

(51) Int. Cl.
*B65B 13/12* (2006.01)
*B65B 13/16* (2006.01)
(Continued)

(52) U.S. Cl.
CPC ..... *B65B 13/12* (2013.01); *B65B 13/16* (2013.01); *B65B 13/04* (2013.01); *B65B 13/10* (2013.01)

(58) Field of Classification Search
CPC ..... B65B 13/10; B65B 13/24; B65B 13/04
See application file for complete search history.

(56) References Cited

U.S. PATENT DOCUMENTS 3,324,789 A 6/1967 Buettner
3,600,253 A * 8/1971 Derenthal ..... B65B 13/10 156/468
(Continued)

FOREIGN PATENT DOCUMENTS

CA 2775966 6/2013
FR 1356536 * 3/1964 ..... B65B 13/12
(Continued)

OTHER PUBLICATIONS

English Machine translation of FR 1356536 (Year: 1964).*
(Continued)

*Primary Examiner* — Scott W Dodds
(74) *Attorney, Agent, or Firm* — Craig Fieschko; DeWitt LLP

(57) ABSTRACT

A banding machine applies bands about objects for packaging, decorative, or other purposes. An object is banded with tape by: grasping a starting end of a tape extending from a tape roll between a first roller and a brake, with the first roller being situated adjacent the object alongside a second roller; orbiting the object with tape roll to apply the tape to the circumference of the object; during the orbit, pressing the starting end of the tape against the object with a wiper, and releasing the tape starting end from the brake; upon the tape's orbital approach of the tape starting end, receiving the tape over the first and second rollers; extending a knife between the first and second rollers to cut the tape, thereby defining a finishing end of the tape extending about the object; and pressing the finishing end of the tape against the object with a wiper.

24 Claims, 28 Drawing Sheets

(51) Int. Cl.
*B65B 13/04* (2006.01)
*B65B 13/10* (2006.01)

(56) References Cited

U.S. PATENT DOCUMENTS

| | | | | |
|---|---|---|---|---|
| 3,913,472 | A | 10/1975 | Buck | |
| 4,079,565 | A | 3/1978 | Lancaster, III et al. | |
| 4,593,590 | A | 6/1986 | Gray | |
| 4,656,939 | A * | 4/1987 | Lasauskas | B65B 61/26 101/415.1 |
| 5,070,676 | A | 12/1991 | Laczkowski et al. | |
| 5,088,270 | A | 2/1992 | Diehl | |
| 5,694,748 | A | 12/1997 | Rochman et al. | |
| 6,625,954 | B2 | 9/2003 | Forrest | |
| 8,365,508 | B2 | 2/2013 | Kenney | |
| 2003/0061785 | A1 | 4/2003 | Sakaki et al. | |
| 2004/0040266 | A1 | 3/2004 | Shibazaki et al. | |
| 2004/0211155 | A1 | 10/2004 | Lancaster, III et al. | |
| 2012/0199019 | A1 | 8/2012 | Kenney | |
| 2018/0215569 | A1 | 8/2018 | Le Rigoleur | |
| 2018/0273335 | A1 | 9/2018 | Fox et al. | |

FOREIGN PATENT DOCUMENTS

| | | | |
|---|---|---|---|
| KR | 100597245 | B1 | 7/2006 |
| WO | WO 2011/050029 | A1 | 4/2011 |
| WO | WO 2020/065634 | A2 | 4/2020 |

OTHER PUBLICATIONS

Written Opinion of the International Preliminary Examining Authority, PCT/IB2019/058301, May 7, 2021.
International Search Report & Written Opinion, PCT/US2010/053325, Dec. 10, 2010.
International Search Report & Written Opinion, PCT/US2019/58301, Apr. 28, 2020.

* cited by examiner

BANDING OF OBJECTS WITH TAPE

CROSS-REFERENCE TO RELATED APPLICATIONS

This application claims priority under 35 USC § 119(e) to U.S. Provisional Patent Application 62/738,039 filed Sep. 28, 2018, the entirety of which is incorporated by reference herein.

FIELD OF THE INVENTION

This document concerns an invention relating generally to the field of packaging, and more specifically to the field of applying bands about objects.

BACKGROUND OF THE INVENTION

The reader is directed to U.S. Pat. No. 8,365,508, the contents of which are hereby incorporated by reference, for background. The banding machine noted in U.S. Pat. No. 8,365,508 is particularly designed for banding of objects with "stretch film," that is, a film which elastically stretches as it wraps about a product, and which contracts once tension is removed, such that the overlapping layers of film tend to grip each other upon contraction (thereby holding the film band about the product), and such that the band tightly encircles the product. Stretch film banding is inappropriate for some objects, particularly for objects where there is a desire to have the film band positively adhere to an object (whereby the film band can more significantly enhance the object's integrity/durability), and/or where aesthetic appearance is of significant importance. Additionally, printing on stretch film is difficult, particularly in such a manner that the printing is not distorted following stretching/contraction of the film.

SUMMARY OF THE INVENTION

The invention, which is defined by the claims set forth at the end of this document, is directed to banding methods and devices which can accommodate less elastic—including inelastic—materials, such as paper tape (which can beneficially be pre-printed, or at least more readily printable). The use of one-sided adhesive tape, i.e., tape having adhesive applied to one side of the tape along its length, is particularly contemplated, as such tape will self-adhere to the product and/or to itself. A basic understanding of some of the features of an exemplary version of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring to FIG. 1, an exemplary banding machine 100 has a table 102 on which an object 200 to be banded can be placed, with the table 102 bearing a slot 104 through which the band is applied to the object 200. FIG. 2 then illustrates some of the primary components within the banding machine 100 of FIG. 1 used to accomplish banding. A rotatable spool 106 bears a roll of tape 300 (e.g., one-sided adhesive tape) which travels along an orbital path about the table 102 (not shown in FIG. 2), and the object 200 thereon, with tape unspooling from the roll 300 to band the object 200, and with a tape handling assembly 108 assisting such banding. Some of the primary components of the tape handling assembly 108 are shown in greater detail in FIG. 3, including: spaced rotatable first and second rollers 110 and 112, which are situated along a chord of the orbital path traveled by the tape roll 300 (a "chord" being a line segment whose endpoints both lie on the circle defined by the orbit); a first wiper 114 translatable within the plane of the orbital path (the "orbital plane") between a first wiper wiping position situated along the chord, and a first wiper non-wiping position away from the chord, wherein the first wiper wiping position is laterally spaced from the rollers 110 and 112 in a first direction (here a leftward direction); a second wiper 116 translatable within the orbital plane between a second wiper wiping position situated along the chord, and a second wiper non-wiping position away from the chord, wherein the second wiper wiping position is laterally spaced from the rollers 110 and 112 in a second direction opposite the first (here a rightward direction); a brake 118 translatable within the orbital plane toward and away from the first roller 110, preferably along a brake path oriented at least approximately perpendicular to the chord of the orbital path, between a tape grasping position and a tape release position; and a knife 120 translatable within the orbital plane toward a cutting position within a cutting space between the first and second rollers 110 and 112, and away from the cutting space to a non-cutting position.

All of the rollers 110 and 112, wipers 114 and 116, brake 118, and knife 120 are translatable into and out of the orbital plane in a direction approximately perpendicular to the plane, or can otherwise be insertable and removable into and out of the orbital plane (as by rotating them into/out of the plane). The brake 118 and knife 120, and preferably the second wiper 116 as well, can be provided on a subcarriage 122 (see FIG. 4 for detail) whereby they can be inserted into and removed from the orbital plane as a unit, though they could instead be configured for independent insertion/removal. In contrast, the first wiper 114 and rollers 110 and 112 preferably move into and out of the orbital plane independently of the brake 118, knife 120, and second wiper 116, and independently of each other. To illustrate, compare FIG. 23B, showing the subcarriage 122 inserted into a subcarriage in-plane state, versus FIG. 22B, showing the subcarriage 122 removed into a subcarriage out-of-plane state; and compare FIG. 19B, showing the first wiper 114 inserted into a first wiper in-plane state, and FIG. 20B, showing the first wiper 114 removed into a first wiper out-of-plane state (with the first wiper 114 also being in its first wiper non-wiping position in both instances). All drawings show the rollers 110 and 112 inserted into a roller in-plane state, though as discussed below, they may be retracted into a roller out-of-plane state.

Similarly, the wipers 114 and 116, brake 118, and knife 120 can move within the orbital plane, preferably in a direction approximately perpendicular to the chord. In the depicted arrangement, the brake 118 and knife 120, and preferably the second wiper 116 as well, can so move as a unit on the subcarriage 122, with the first wiper 114 translating independently. Compare, for example, FIG. 12A, showing the subcarriage 122 situating the brake 118, knife 120, and second wiper 116 in a subcarriage cutting/wiping position on or adjacent to the chord (the brake 118 being in its tape grasping position, the knife 120 being in its cutting position, and the second wiper 116 being in its wiping position), and FIG. 16A, showing the subcarriage 122 situating the brake 118, knife 120, and second wiper 116 in a subcarriage withdrawn position spaced from the chord (the brake 118 being in its tape release position, the knife 120 being in its non-cutting position, and the second wiper 116 being in its non-wiping position). See also FIG. 12A, showing the first wiper 114 in its first wiper non-wiping position, and FIG. 13A, showing the first wiper 114 in its first wiper wiping position.

In the foregoing arrangement, each of the first and second wipers 114 and 116 has a pivot axis 124 with a wiper surface 126 extending therefrom, wherein the wiper surface 126 is pivotable 102 toward the chord (see particularly FIG. 4 for details of this arrangement with the second wiper 116). Each wiper's pivot axis 124 is situated such that when the wiper is moved into its wiping position, the pivot axis 124 is situated between the wiper surface 126 and the wiper's closest roller (that is, the first roller 110 for the first wiper 114, and the second roller 112 for the second wiper 116), such that the wipers 114 and 116 pivot inwardly toward each other. To illustrate, FIGS. 13A and 13B respectively show the first wiper 114 in unpivoted and pivoted positions, and FIGS. 24A and 24B respectively show the second wiper 116 in unpivoted and pivoted positions. The wiper surfaces 126 are preferably formed of flexible materials (e.g., elastomeric flaps) whereby the wipers 114 and 116 can yield/bend under force, such that when the wiper surfaces 126 are urged against an object 200, the wipers 114 and 116 will resiliently yield while maintaining pressure on the object 200.

As also seen in FIG. 3, the rollers 110 and 112, wipers 114 and 116, brake 118, and knife 120 can be provided on a carriage 128 such that they can translate as a unit in at direction approximately parallel to the chord. See, for example, FIG. 12A, showing the carriage 128 in a carriage starting position; FIG. 18A, showing the carriage 128 in a tape starting end wiping position; and FIG. 26A, showing the carriage 128 in a tape finishing end wiping position.

Also in the foregoing arrangement, the brake 118 is preferably configured to resiliently yield to an opposing force, as by providing springs or other compressible structures (not shown) between the brake 118 and subcarriage 122 in FIG. 4. Thus, if the subcarriage 122 is moved toward its subcarriage cutting/wiping position (such translation being seen, for example, in FIG. 23A and FIG. 24A) until the brake 118 encounters the first roller 110, the brake 118 will halt against the first roller 110, though the subcarriage 122 may continue to move to some extent.

FIGS. 5A-29C then illustrate a banding process performed by the exemplary banding machine 100. In the following discussion of this process (and throughout the remainder of this document), all Figures sharing a common reference numeral will typically be collectively referred to by that reference numeral (for example, FIGS. 5A-5C will be collectively referred to as FIG. 5). Moreover, all Figures using the letter A provide a front elevational view of the tape handling assembly 108; all Figures using the letter B provide an isometric view of the tape handling assembly 108 from a viewpoint different from that used in FIG. 3; and all Figures using the letter C schematically depict the travel of a roll of tape 300 (here one-sided adhesive tape, with the adhesive face of the tape being applied to the object 200) within the banding machine 100 during the banding process, along with the actions of certain components of the tape handling assembly 108 within the orbital plane in which the tape roll 300 travels.

Looking initially to FIGS. 5-11, these show possible steps for the installation of the tape roll 300 in the exemplary banding machine 100 in preparation for banding of an object 200. In FIG. 5 (particularly FIG. 5C), the tape roll 300 is provided on the spool 106 at a spool loading position (here chosen to be a position above the table 102, which is not shown). The (exposed) end of the tape is unspooled from the tape roll 300 and maintained in a fixed position (e.g., by adhering it to a stop 130) at a location outside the orbital path, preferably nearby the spool loading position. The first and second rollers 110 and 112 (FIGS. 5A-5B) are situated on the tape handling assembly 108 within the orbital plane (that is, in the roller in-plane state, as in all of FIGS. 5-11), with the first wiper 114 and the subcarriage 122 (including the second wiper 116, brake 118, and knife 120) withdrawn from the orbital plane (see particularly FIG. 5B).

In FIG. 6 (particularly FIG. 6C), the spool 106 travels along the orbital path with the tape roll 300 thereon, with the end of the tape maintained in the fixed position, whereby the tape unspools from the tape roll 300.

In FIG. 7 (particularly FIG. 7C), the spool 106 and tape roll 300 continue to travel along the orbital path with the tape unspooling from the tape roll 300, and the tape begins wrapping about the second roller 112.

In FIG. 8 (particularly FIG. 8C), the spool 106 and tape roll 300 continue to travel along the orbital path with the tape unspooling from the tape roll 300, and the tape wraps about both the first and second rollers 110 and 112. The spool travel may then be halted at a spool start position, preferably with the tape extending between the tape roll 300 and the first and second rollers 110 and 112 along a plane oriented approximately parallel to the chord defined by the first and second rollers 110 and 112. The subcarriage 122, including the brake 118, knife 120, and second wiper 116, are translated or otherwise inserted into the orbital plane (see particularly FIG. 8B).

In FIG. 9 (particularly FIG. 9C), following insertion of the subcarriage 122 into the orbital plane, the subcarriage 122 is moved within the orbital plane toward the first and second rollers 110 and 112 to its subcarriage cutting/wiping position (compare FIG. 9A with FIG. 8A). As this occurs, the brake 118 is moved within the orbital plane toward the first roller 110, whereby the tape is grasped between the brake 118 and the first roller 110. The knife 120 is moved within the orbital plane toward the cutting space between the first and second rollers 110 and 112, thereby cutting the tape within the cutting space between the rollers 110 and 112.

In FIG. 10 (particularly FIG. 10C), the length of tape between the tape end and the brake 118 may be removed, leaving the length of the tape extending between the brake 118 and the tape roll 300. By simply pulling this length of tape away from the second roller 112, the second roller 112 rotates to unwind the adhered tape from the second roller's surface.

In FIG. 11, the first wiper 114 (see particularly FIG. 11B) is translated or otherwise inserted into the orbital plane alongside the subcarriage 122 (including its brake 118, knife 120, and second wiper 116). The banding machine 100 is then ready to band objects with the tape.

FIGS. 12-29 then illustrate exemplary steps for banding of an object 200 with the tape. As noted above, in FIG. 11, the banding machine 100 is ready to band objects with the tape. In FIG. 12 (particularly FIG. 12C), an object 200 to be banded is placed within the orbital path of the spool 106 and the tape roll 300, and on the table 102 (shown only in FIG. 1), which rests along a plane approximately parallel to the chord defined by the first and second rollers 110 and 112. The first and second rollers 110 and 112 are situated adjacent the table 102 between the object 200 and the orbital path. A tape starting end, which will be applied to the object 200 first, is defined by the end of the tape situated between the brake 118 and the first roller 110. In FIG. 13 (see particularly FIGS. 13A and 13C), the first wiper 114 is moved toward the first wiper wiping position (situated leftward from the rollers 110 and 112), and against the portion of the tape between the tape roll 300 and the tape starting end (between the brake 118 and the first roller 110), thereby grasping the tape starting end.

In FIG. 14, the first wiper 114 is urged against the object 200 (preferably by pivoting the first wiper 114 toward the object 200), with the tape being situated between the first wiper 114 and the object 200, with at least the end tip of the wiper surface 126 thereby pressing the adhesive-bearing side of the tape against the object 200.

In FIG. 15, with the first wiper 114 pressing the tape against the object 200, and with the tape starting end being grasped between the brake 118 and the first roller 110, the spool 106 (and the tape roll 300 thereon) begins traveling along the orbital path, whereby the tape unspools from the roll 300 during travel to wrap about the object 200. The length of tape extending from the tape roll 300 becomes more firmly affixed to the object 200 as more of the adhesive-bearing side of the tape engages the object 200.

In FIG. 16, as the spool 106 and tape roll 300 continue travel about (and application of tape to) the object 200, the brake 118 may be moved away from the first roller 110 within the orbital plane, thereby releasing the tape starting end. (More generally, the subcarriage 122 with the brake 118, knife 120, and second wiper 116 may be moved away from the chord along which the rollers 110 and 112 rest; compare FIG. 16A with FIG. 15A.) This may be done once the tape has sufficiently adhered to the object 200 to such an extent that the brake 118 need no longer restrain the tape to prevent it from releasing from the object 200 owing to any tension exerted by the traveling tape roll 300.

In FIG. 17, as the spool 106 and tape roll 300 continue travel about (and application of tape to) the object 200, the brake 118 (more generally the subcarriage 122) may be translated or otherwise withdrawn from the orbital plane; compare FIG. 17B with FIG. 16B.

In FIG. 18, as the spool 106 and tape roll 300 continue travel about (and application of tape to) the object 200, the first wiper 114 is moved along the object 200 toward the tape starting end, urging the entirety of the tape starting end against the object 200, and adhering it to the object 200. As seen in FIGS. 18A and 18B, this may be done by translating the carriage 128 (more generally, the carriage 128 on which the subcarriage 122 rides) in a direction approximately parallel to the chord defined by the first and second rollers 110 and 112, and opposite the direction in which the tape was applied to the object 200. As this occurs, the first roller 110 rotates to unwind the adhered tape from the first roller's surface.

In FIG. 19, as the spool 106 and tape roll 300 continue travel about (and application of tape to) the object 200, the first wiper 114 may be moved away from the object 200 once the entirety of the tape starting end has been urged against (and adhered to) the object 200. Compare FIGS. 19A-B with FIGS. 18A-B.

In FIG. 20, as the spool 106 and tape roll 300 continue travel about (and application of tape to) the object 200, the first wiper 114 may be moved out of the plane of the orbital path. Compare FIG. 20B with FIG. 19B.

In FIG. 21, as the spool 106 and tape roll 300 continue travel about (and application of tape to) the object 200, the rollers 110 and 112 (and more generally, the carriage 128) are moved within the orbital plane in a direction approximately parallel to the chord defined by the first and second rollers 110 and 112, and corresponding to the direction in which the tape was applied to the object 200. The rollers 110 and 112 (and more generally, the carriage 128) are halted at a location adjacent the object 200 which corresponds to where the tape will be finally applied to the object 200, and where the tape will be cut to define a finishing end of the tape.

In FIG. 22, as the spool 106 and tape roll 300 continue travel about the object 200, the tape unspools from the roll 300 to wrap about the first and second rollers 110 and 112. The spool travel may then be halted, preferably at a location such that the tape extends between the tape roll 300 and the first and second rollers 110 and 112 along a plane oriented approximately parallel to the chord defined by the first and second rollers 110 and 112.

In FIG. 23, the brake 118 and knife 120 (and more generally, the subcarriage 122 bearing the brake 118, knife 120, and second wiper 116) are translated or otherwise inserted into the orbital plane, with the brake 118 being situated opposite the first roller 110 and the tape thereon.

In FIG. 24, the subcarriage 122 is moved within the orbital plane toward the first and second rollers 110 and 112. As this occurs, the brake 118 is moved within the orbital plane toward the first roller 110, whereby the tape is grasped between the brake 118 and the first roller 110. The knife 120 is moved within the orbital plane toward the cutting space between the first and second rollers 110 and 112, thereby cutting the tape within the cutting space, and defining the finishing end of the tape, which extends from the object 200 to adhere to the surface of the second roller 112. The second wiper 116 is moved within the orbital plane toward the second wiper wiping position situated rightward of the rollers 110 and 112, urging the second wiper 116 against the tape finishing end. As it does so, the tape extending from the object 200 to the second roller 112 (to which the tape finishing end is adhered) can yield to the second wiper 116 as the second roller 112 rotates to unwind the adhered tape from the second roller's surface.

In FIG. 25, the second wiper 116 is urged against the object 200 (preferably by pivoting the second wiper 116 toward the object 200), with the tape finishing end being situated between the second wiper 116 and the object 200, with at least the end tip of the wiper surface 126 thereby pressing the adhesive-bearing side of the tape finishing end against the object 200.

In FIG. 26, with the second wiper 116 pressing the tape against the object 200, the second wiper 116 is moved along the object 200 toward the tape finishing end, urging the entirety of the tape finishing end against the object 200 and adhering it to the object 200. As seen in FIGS. 26A and 26B, this may be done by translating the carriage 128 in a direction approximately parallel to the chord defined by the first and second rollers 110 and 112, and corresponding to the direction in which the tape was applied to the object 200. As this occurs, the second roller 112 rotates to unwind the adhered tape from the second roller's surface.

In FIG. 27, the second wiper 116 is withdrawn from the object 200 and the tape finishing end thereon, as by pivoting the second wiper 116 away from the object 200.

In FIG. 28, the brake 118 and knife 120 (and more generally, the carriage 128, including the first wiper 114 and the subcarriage 122 bearing the brake 118, knife 120, and second wiper 116) are moved back to the carriage starting position shown in FIG. 11.

In FIG. 29, the first wiper 114 is translated or otherwise inserted back into the orbital plane (see particularly FIG. 29B). The banding machine 100 is then in the starting condition shown in FIG. 11, and is ready to band another object 200 once the depicted banded object 200 is removed and a new object 200 to be banded is placed within the orbit of the tape roll 300 as in FIG. 11.

The foregoing summary merely relates to an exemplary preferred version of the invention, and variations are possible. As an example (discussed further below), the second roller may be omitted, and the foregoing steps may be performed without the second roller.

Further potential advantages, features, and objectives of the invention will be apparent from the remainder of this document in conjunction with the associated drawings.

DETAILED DESCRIPTION OF EXEMPLARY VERSIONS OF THE INVENTION

Figure 1:
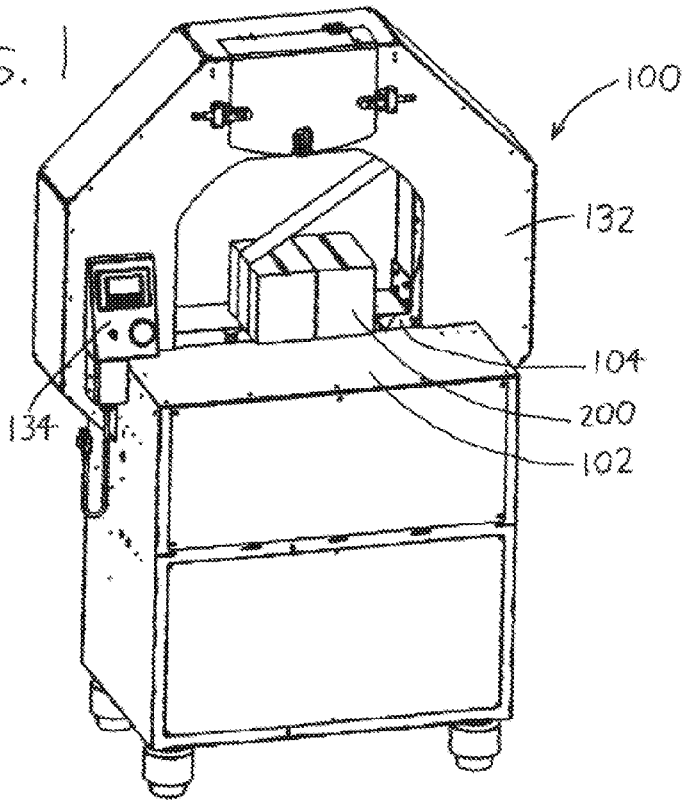
FIG. 1 is an isometric view of a banding machine 100 exemplifying the invention.
Figure 2:
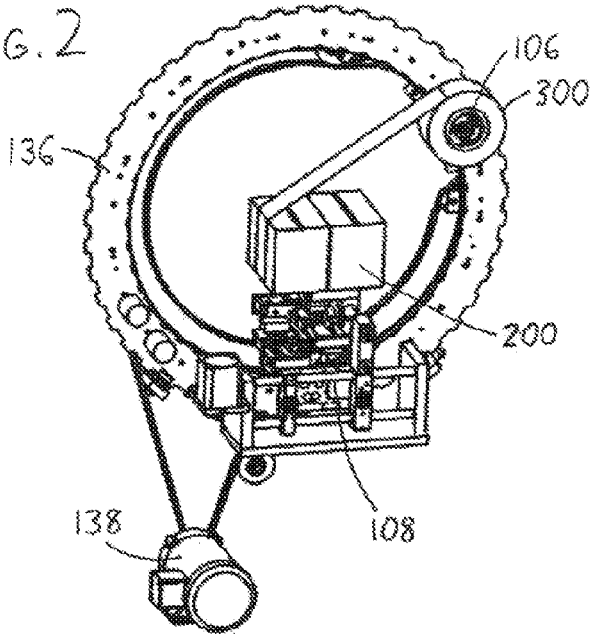
FIG. 2 is an isometric view of components within the banding machine 100 of FIG. 1.

Expanding on the discussion above, the exemplary banding machine 100 of FIG. 1 has a housing 132 containing the components shown in FIG. 2, with the housing 132 including the table 102 upon which a user situates an object 200 to be banded. The user places the object 200 upon the table 102, with the object 200 being aligned with the slot 104 in the table 102 (through which the band is applied to the object 200), and initiates the banding process via the associated control panel 134. The object 200 is rapidly banded, and the user may then remove the banded object 200 from the table 102 and replace it (when desired) with a subsequent object 200 to be banded, again using the control panel 134 to initiate banding of the subsequent object 200. Thus, the exemplary banding machine 100 is intended for successively applying bands to objects on an as-needed basis, regardless of whether the objects are of the same size/shape or of differing sizes/shapes. However, the described components and processes could be adapted for automated banding of objects, for example, repeated banding of successive objects being conveyed along a production line.

The banding machine components shown in FIG. 2 include a rotating ring 136 and the tape handling assembly 108. The ring 136 is driven by a motor 138 to orbit the spool 106 carrying the tape roll 300 about the object 200 to be banded. The tape handling assembly 108 then inserts/withdraws the rollers 110 and 112, knife 120, brake 118, wipers 114 and 116, etc. (FIG. 3) into and out of the orbital plane, and moves these components within the orbital plane as discussed. It is notable that the spool 106 preferably acts as described in U.S. Pat. No. 8,365,508, and has a mechanism which applies tension to the unwinding tape (as by constantly driving the spool 106 to wind the tape, but providing a slip clutch allowing the tape to be unwound during such winding). Such an arrangement helps avoid slack and/or excessive tightness of the applied band, which can lead to unsightly and/or ill-fit bands. However, depending on the objects to be banded and other conditions, counterwinding of the spool 106 may be unnecessary. Alternatively, simple measures for providing tape tension, such as merely having the spool 106 exert resistance to unwinding, might be sufficient.

Figure 3:
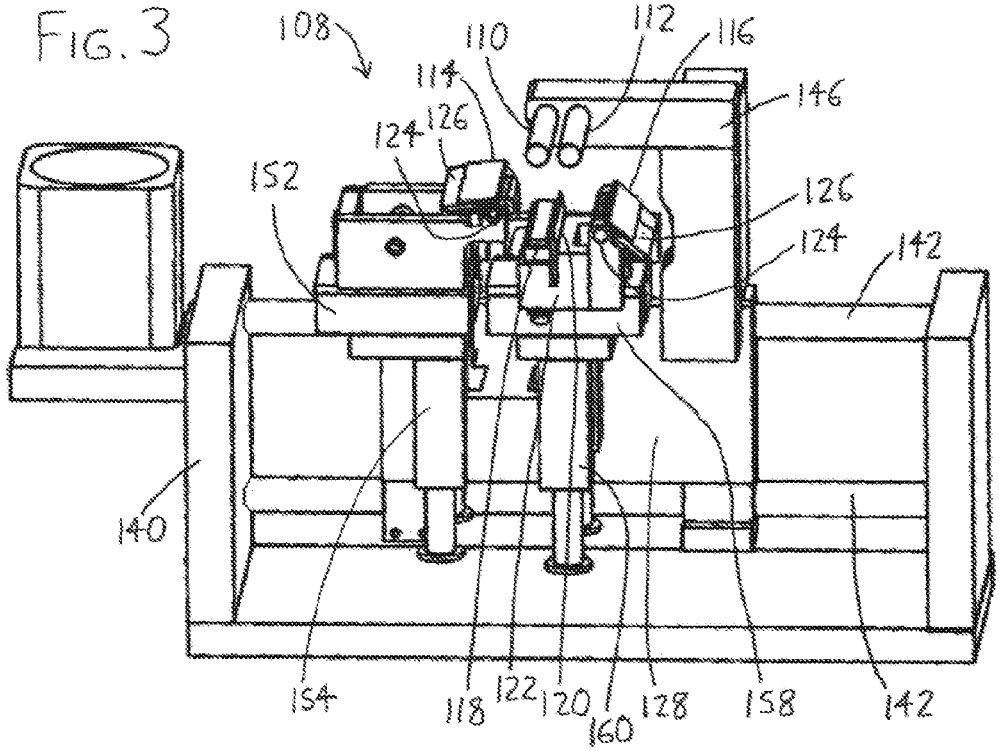
FIG. 3 is an isometric view detailing the tape handling assembly 108 shown in FIG. 2.
Figure 4:
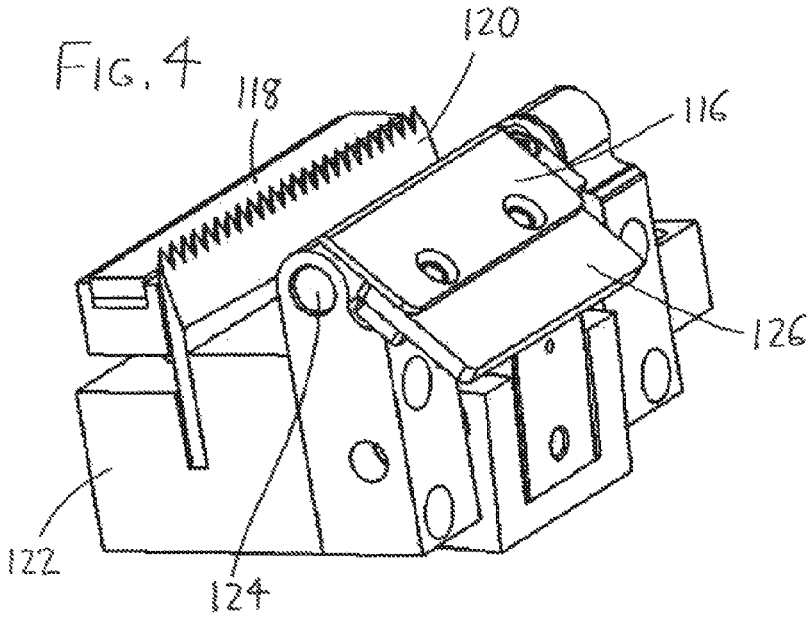
FIG. 4 is an isometric view detailing the cutting/wiping subassembly (the subcarriage 122) shown in FIG. 2.
Figure 18A:
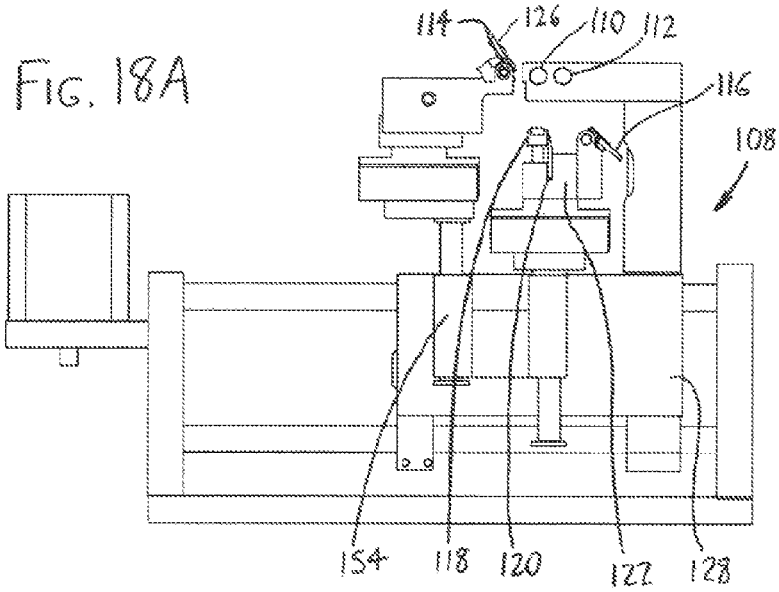
Figure 18B:
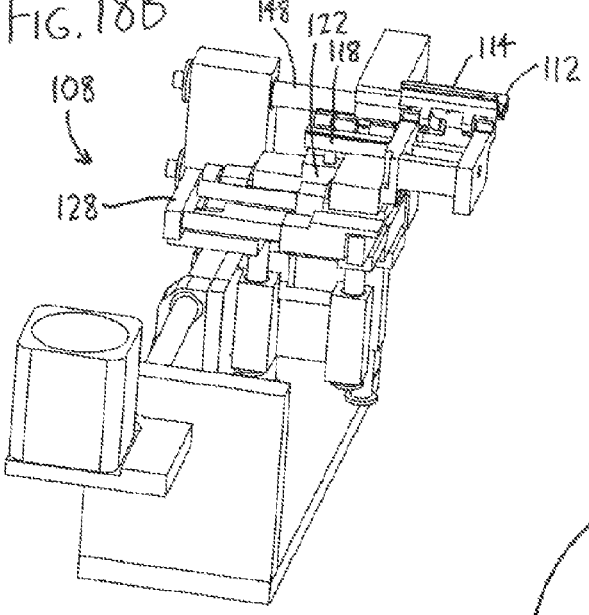
Figure 18C:
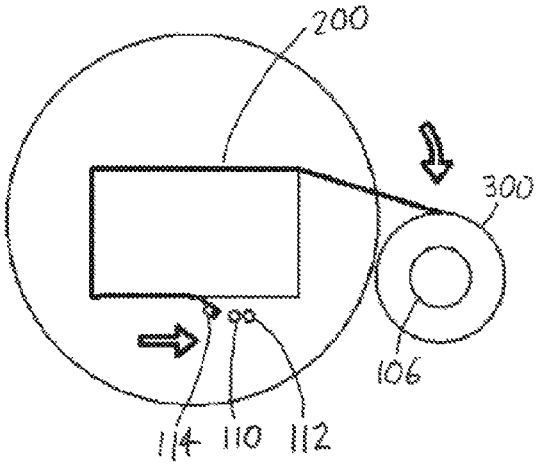
Figure 19A:
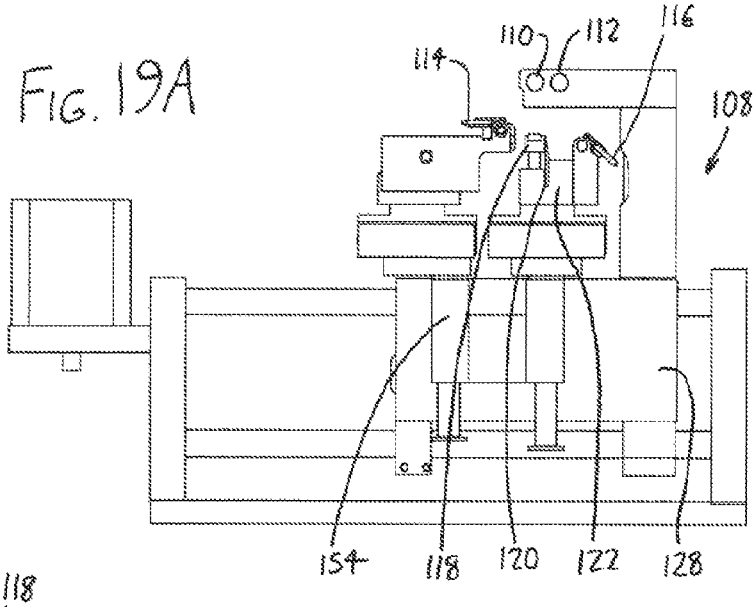
Figure 19B:
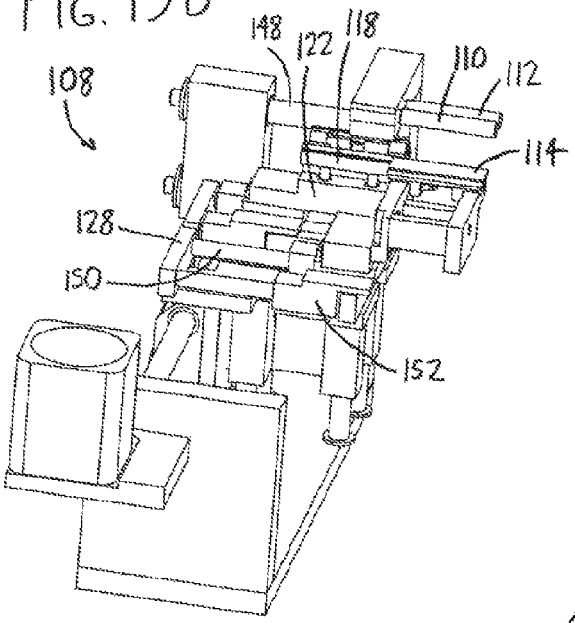
Figure 19C:
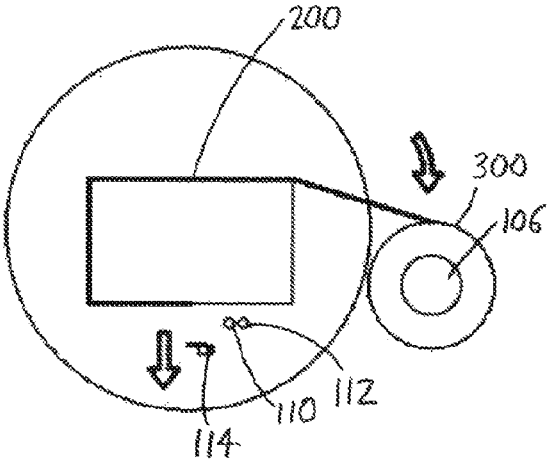
Figure 20A:
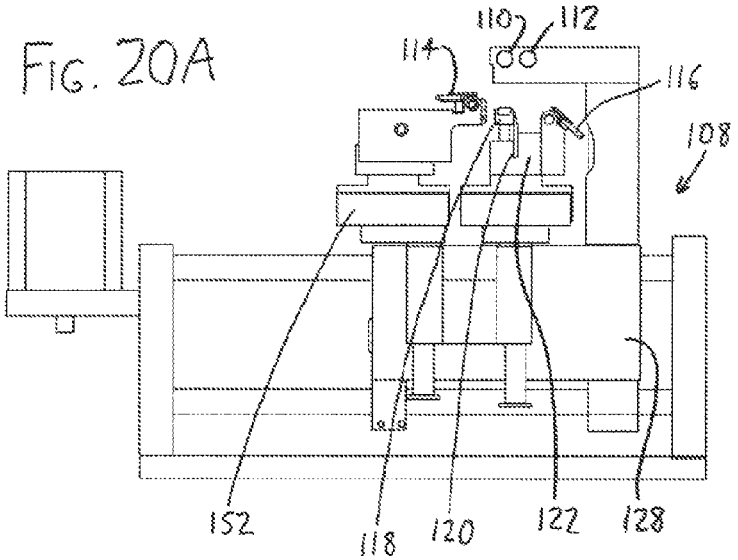
Figure 20B:
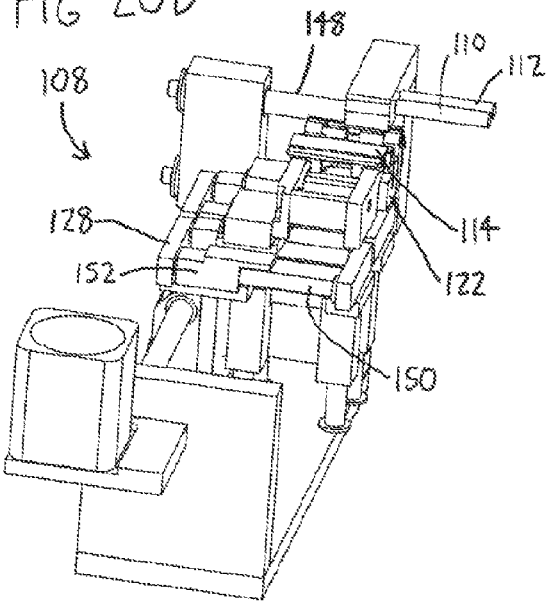
Figure 20C:
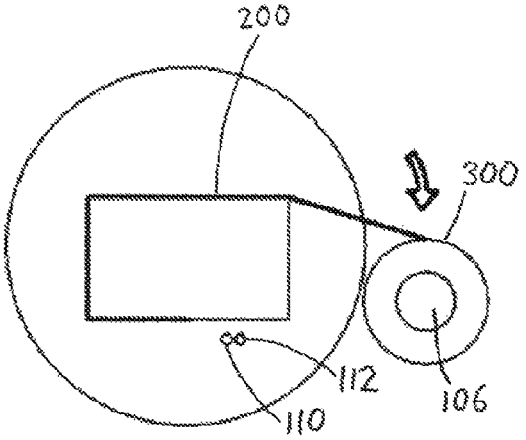
Figure 21A:
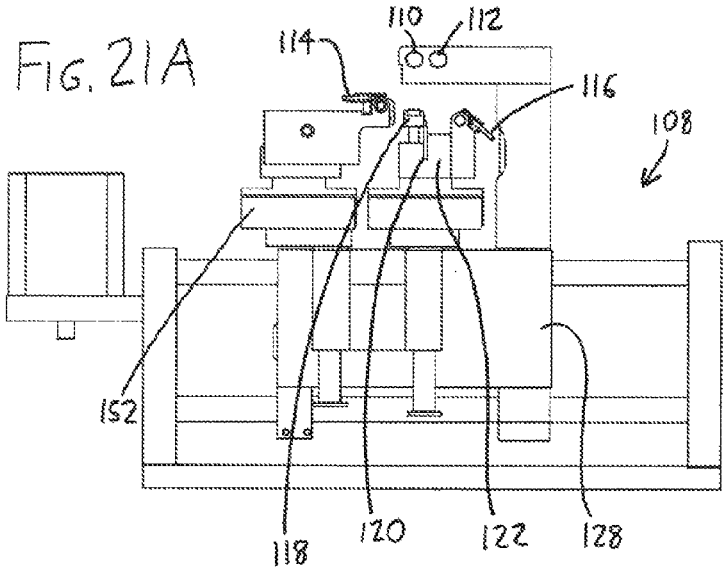
Figure 21B:
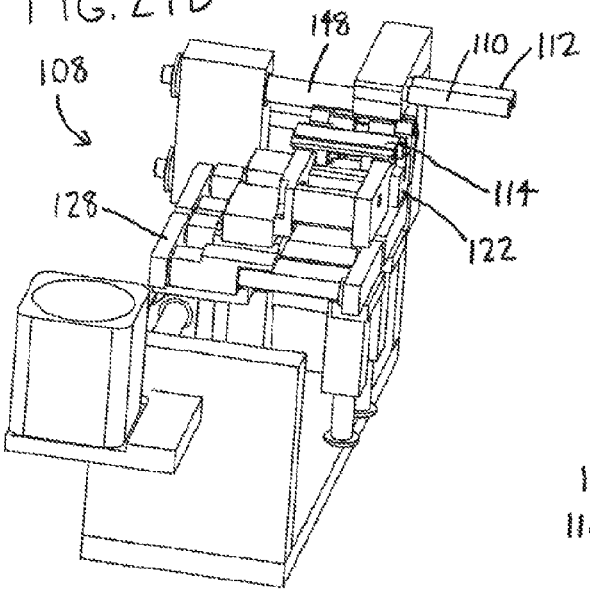
Figure 21C:
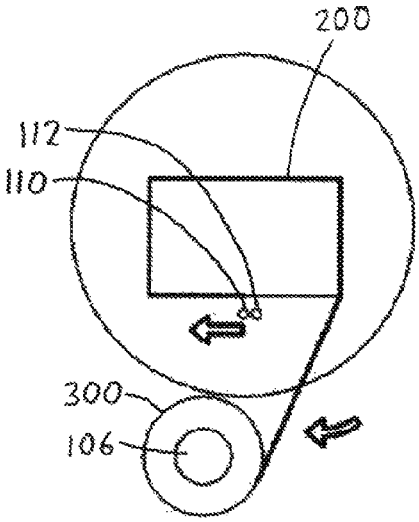
Figure 22A:
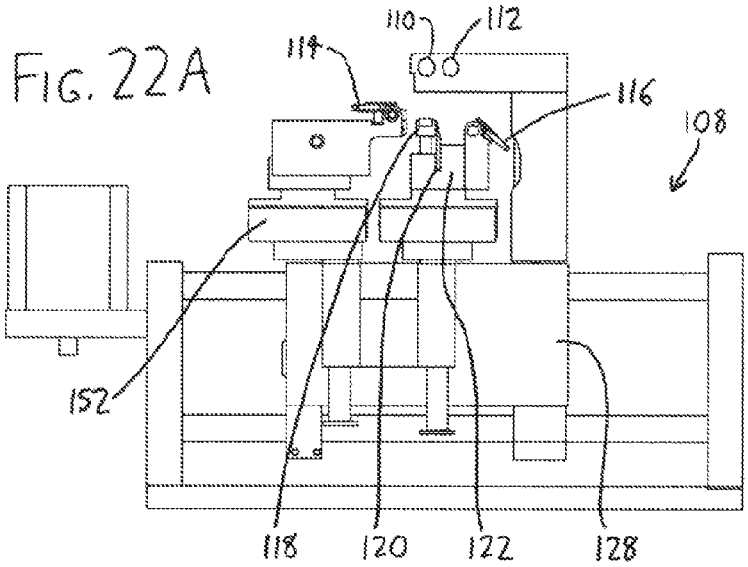
Figure 22B:
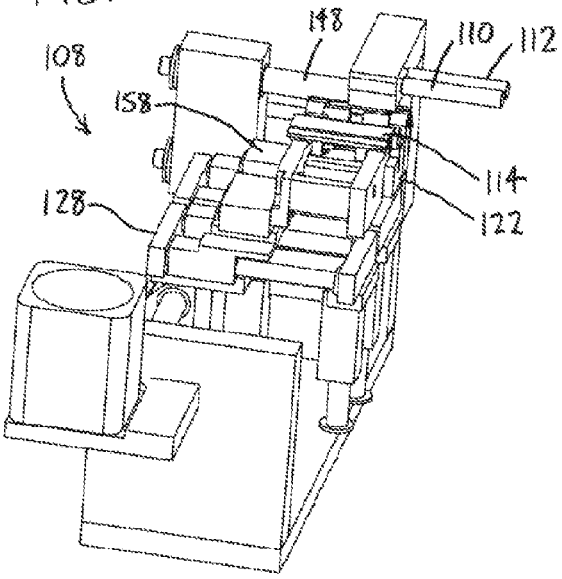
Figure 22C:
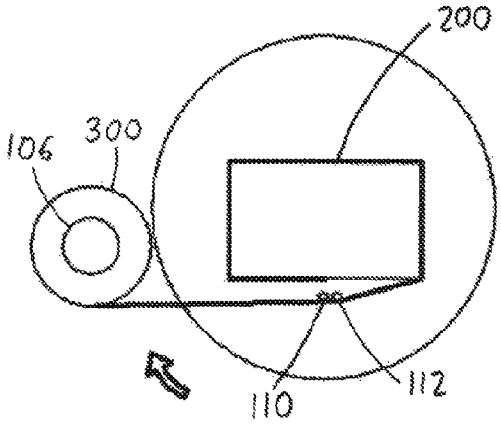
Figure 23A:
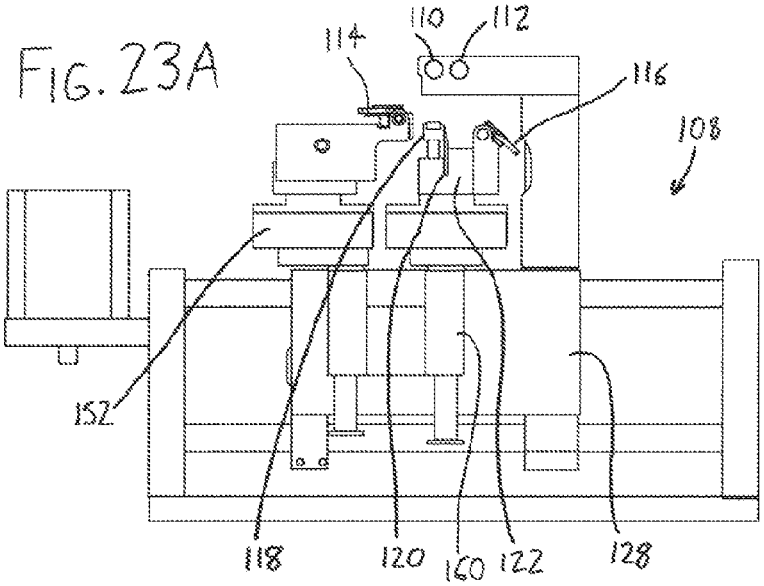
Figure 23B:
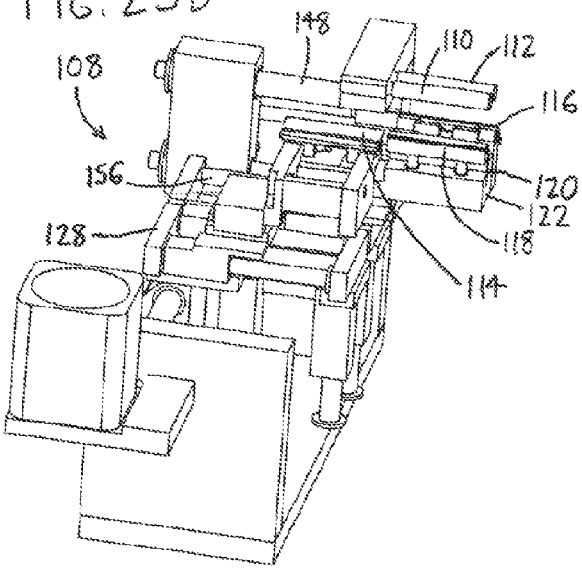
Figure 24A:
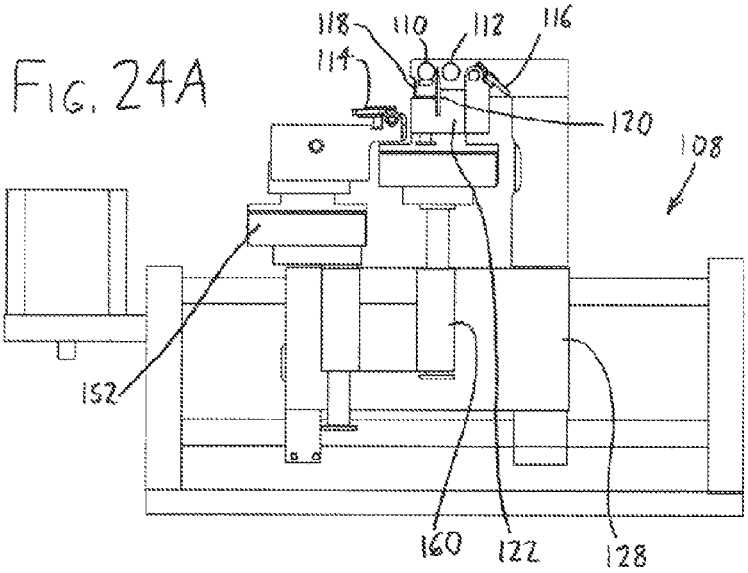
Figure 24B:
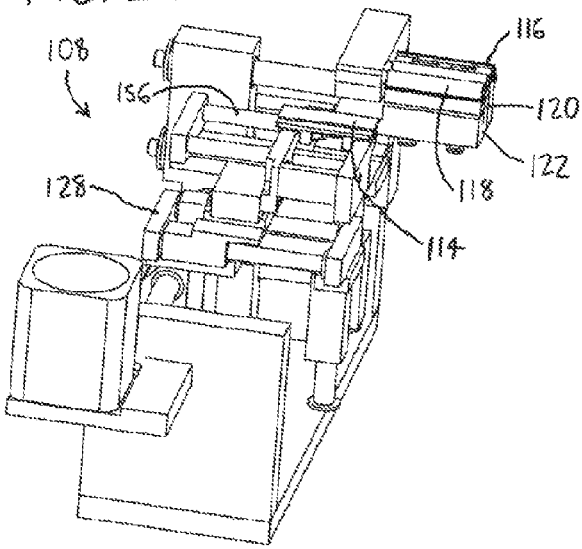

FIG. 3 then illustrates the tape handling assembly 108 in detail. The assembly 108 has a frame 140 with rails 142 extending between its opposing sides, with the carriage 128 being driven along these rails 142 in directions parallel to the orbital plane via an appropriate actuator 144 (e.g., a stepper motor). The first and second rollers 110 and 112 may freely spin about their axes on roller arm 146, which may be driven into and out of the orbital plane on roller rails 148 extending from the carriage 128 (the roller rails 148 not being shown in FIG. 3, but being visible in, for example, FIG. 20B). As noted previously, all drawings show the rollers 110 and 112 situated in their roller in-plane state (i.e., within the orbital plane), though they may be retracted into a roller out-of-plane state by retracting them along the roller rails 148. The first wiper 114 may be driven into and out of the orbital plane via a first wiper slide 150 (not shown in FIG. 3, but visible in, for example, FIGS. 19B and 20B) provided on a first wiper body 152. The first wiper body 152 is in turn movable within the orbital plane, and in planes parallel thereto, by a first wiper actuator 154 which moves the first wiper body 152 (vertically in FIG. 3) with respect to the carriage 128 (compare FIGS. 18A and 19A for an example of such motion). The subcarriage 122 is driven into and out of the orbital plane via a subcarriage slide 156 (see FIGS. 23B and 24B) provided on a subcarriage body 158 (see FIGS. 3 and 22B, compare FIGS. 22B and 23B for an example of such motion). The subcarriage body 158 is in turn movable within the orbital plane, and in planes parallel thereto, by a subcarriage actuator 160 (FIG. 3) which moves the subcarriage body 158 (vertically in FIG. 3) with respect to the carriage 128 (compare FIGS. 23A and 24A for an example of such motion). The slides 150 and 156, and actuators 154 and 160, need not have the depicted configuration, and can be provided by any suitable actuators (e.g., solenoids, pneumatic/hydraulic pistons, etc.).

Figure 23C:
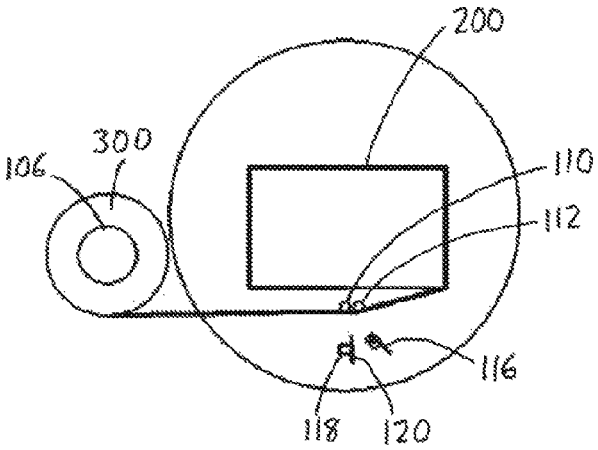
Figure 24C:
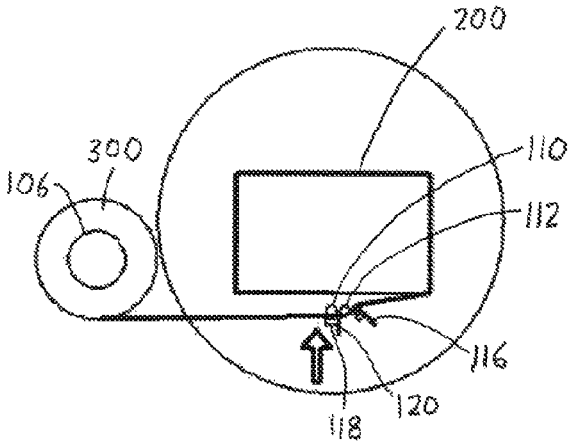
Figure 25A:
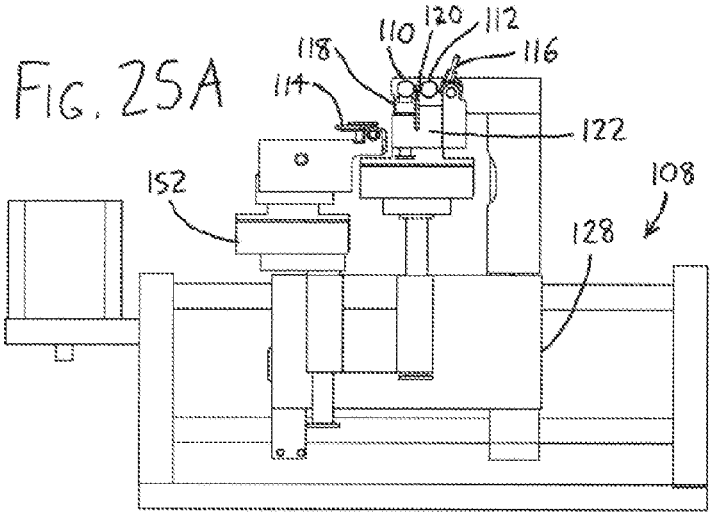
Figure 25B:
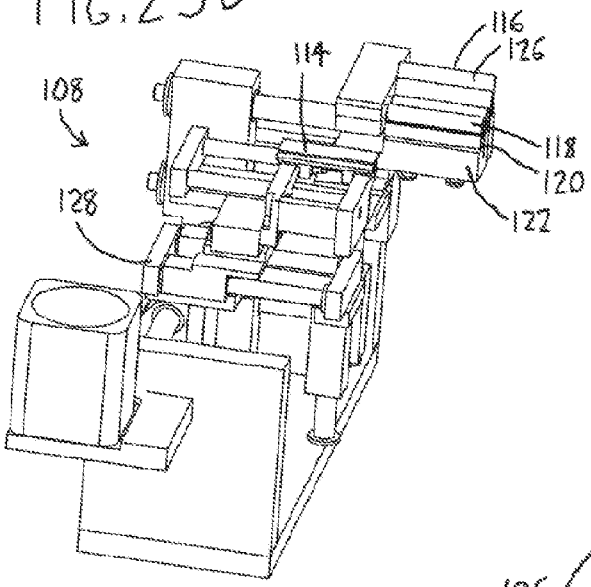
Figure 25C:
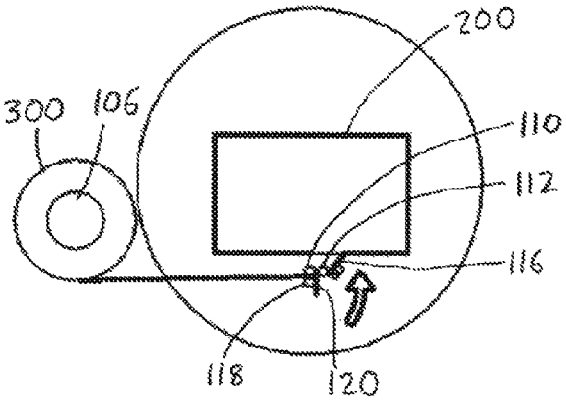
Figure 26A:
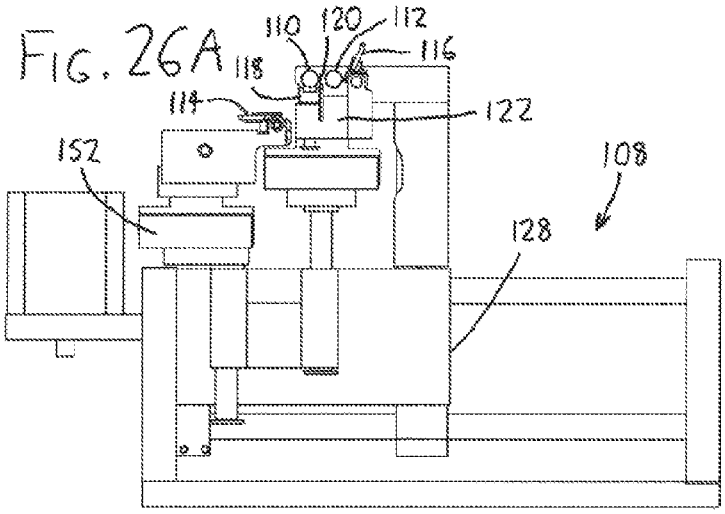
Figure 26B:
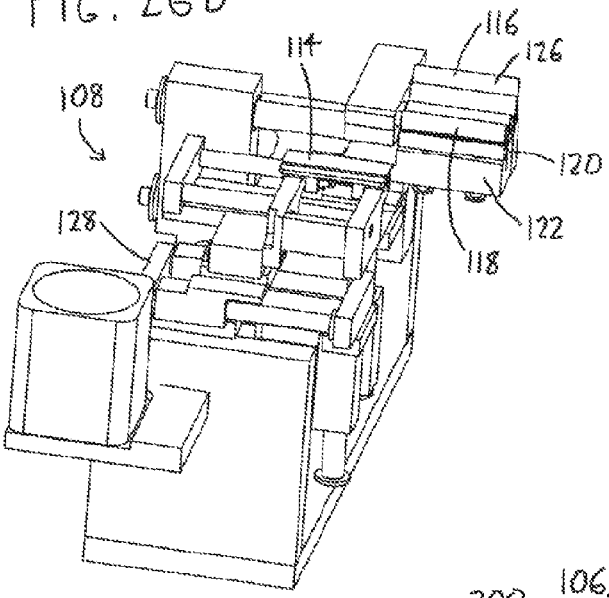
Figure 26C:
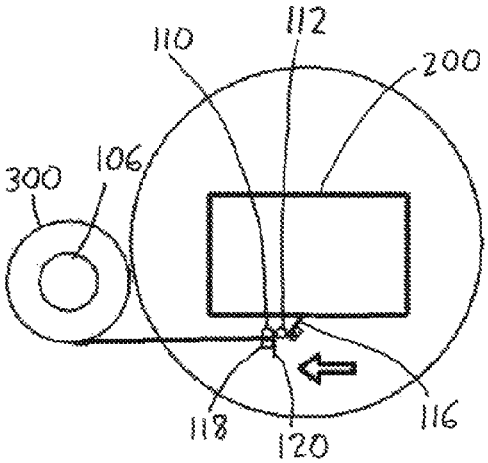
Figure 27A:
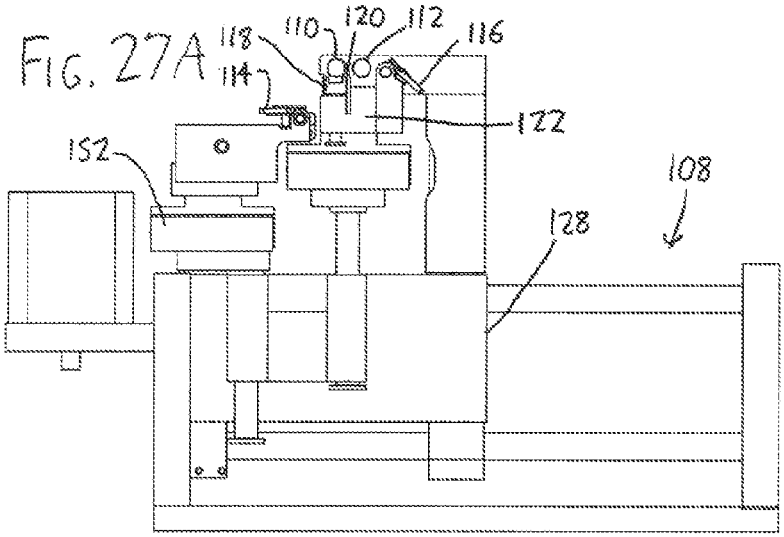
Figure 27B:
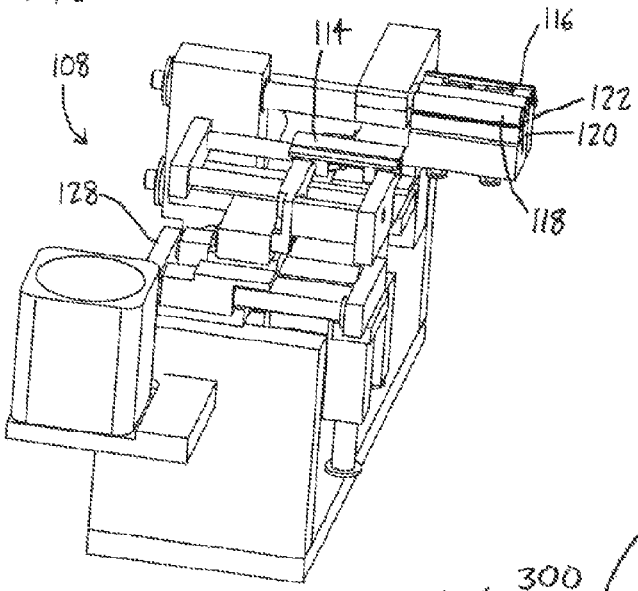
Figure 27C:
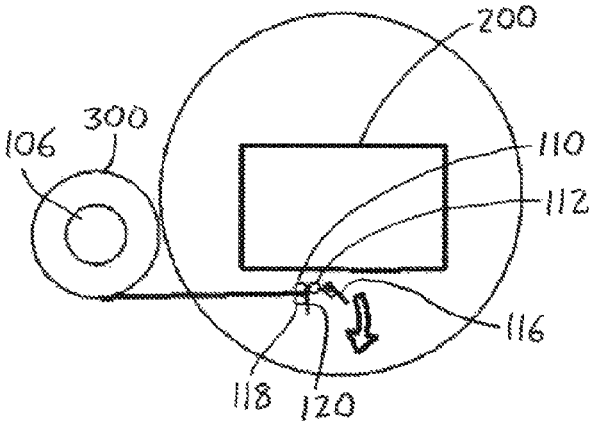
Figure 28A:
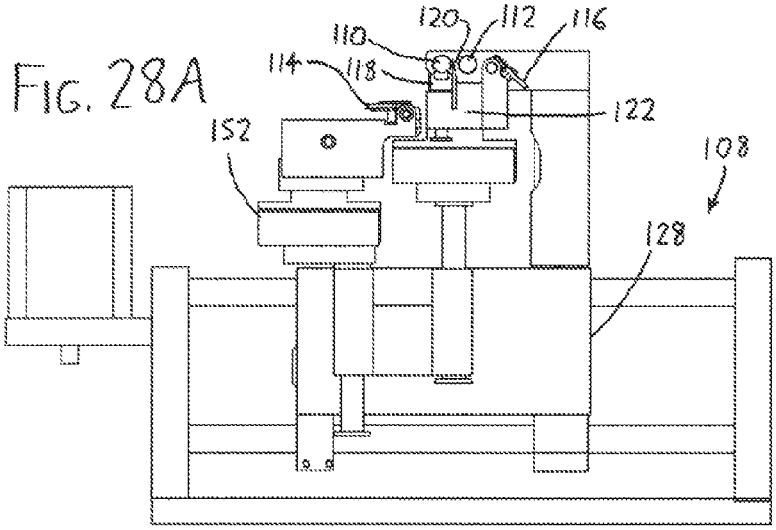
Figure 28B:
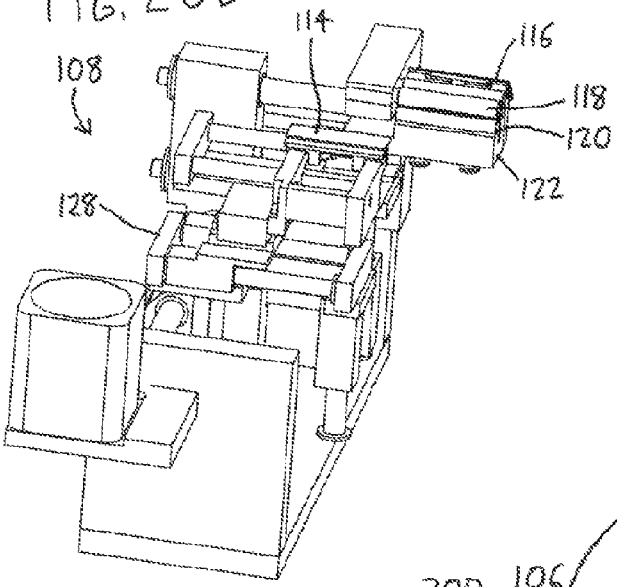
Figure 28C:
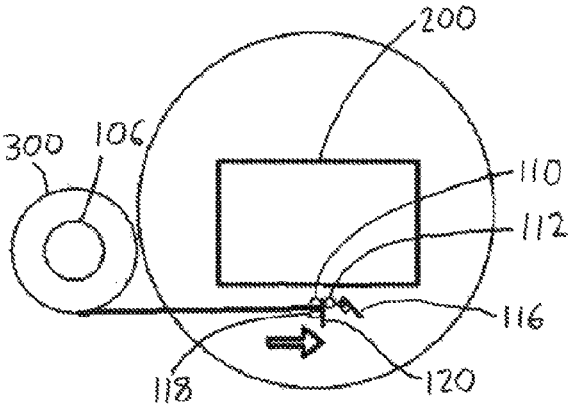
Figure 29A:
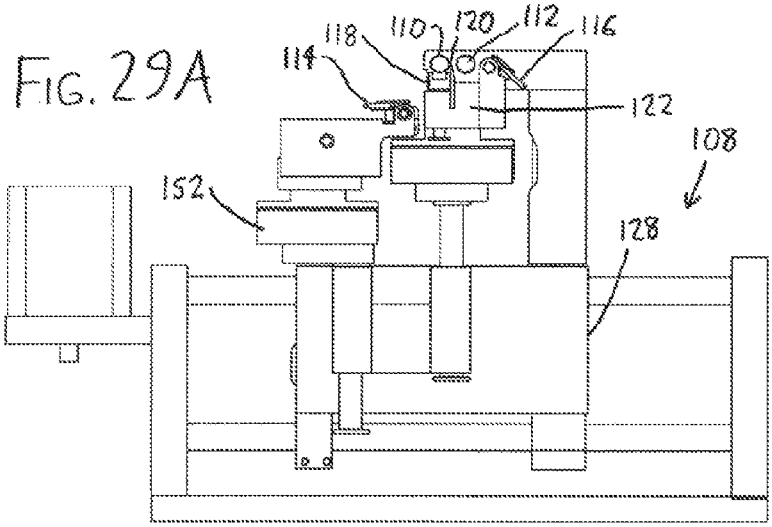
Figure 29B:
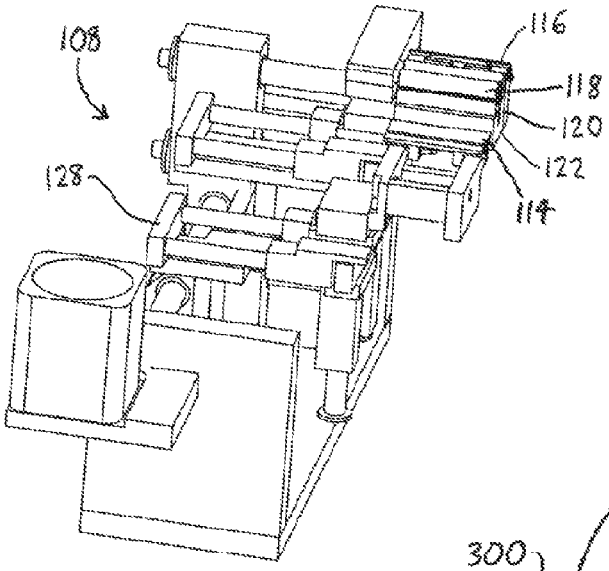
Figure 29C:
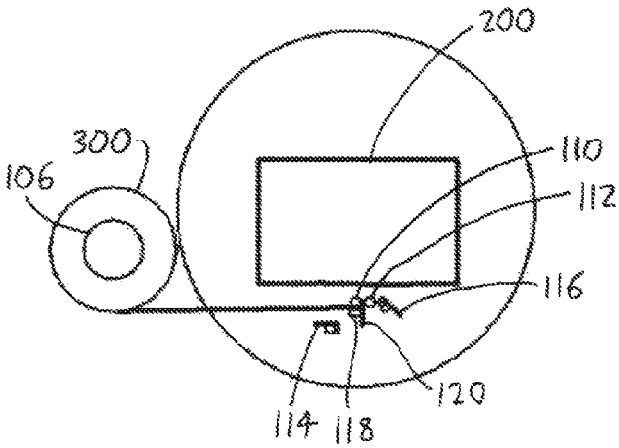

Since the depicted banding machine 100 is merely an exemplary one, it should be understood that the banding machine 100 may have configurations other than the one shown. As one example, as noted above, the brake 118, knife 120, and second wiper 116, or subsets of these components, may travel independently of each other, rather than traveling as a unit on the subcarriage 122. As another example, a second brake might be provided for the second roller 112, either on the subcarriage 122 or independently therefrom, to more affirmatively restrain the tape within the cutting space between the first and second rollers 110 and 112. As yet another example, the banding machine 100 and its banding processes may omit the second roller 112. While the second roller 112 is usefully included—the tape, being adhered to the rollers 110 and 112, is held firm in place in the cutting space between the rollers, thereby helping to provide an exact and predictable cut to the tape—it is not necessary. When the second roller 112 is omitted, it can be useful to adjust the configuration and location of the brake 118, knife 120, and second wiper 116 to accommodate its absence. For example, considering FIGS. 23C and 24C, and the behavior of the tape if the second roller 112 was absent, it may be useful to have the knife 120 more closely approach the first roller 110 when cutting. The knife 120 might even initially impinge on an edge of the first roller 110 as the cut begins, but might be mounted to the subcarriage 122 such that the knife 120 can slightly laterally displace as cutting continues. The knife 120 will therefore yield to the first roller 110, and move tangentially alongside the first roller 110 as cutting continues. It may also be useful to have the second wiper 116 advance further toward the object 200, and/or pivot against the tape earlier, such that the tape finishing end is better pressed against the object 200 upon or immediately after cutting of the tape.

Figure 5A:
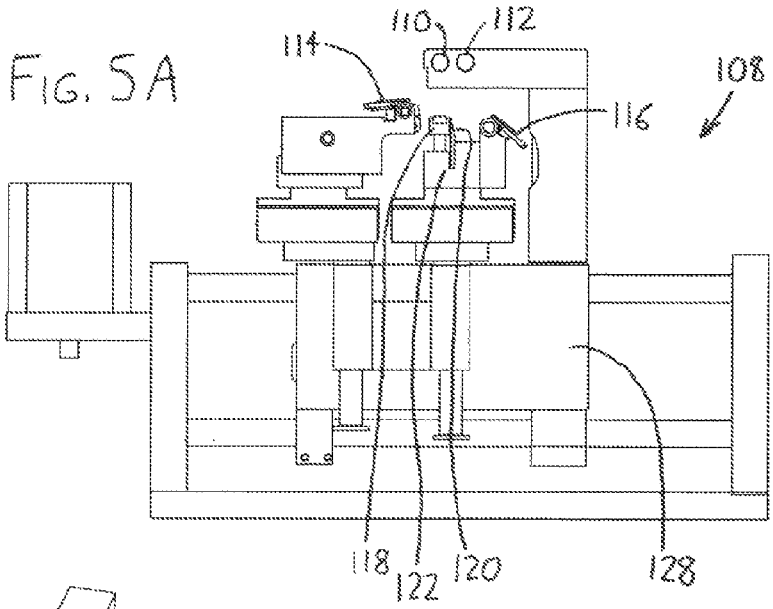
FIGS. 5A-29C illustrate a banding process performed by the banding machine 100 of FIGS. 1-4, wherein all Figures using the letter A provide a front elevational view of the tape handling assembly 108; all Figures using the letter B provide an isometric view of the tape handling assembly 108; and all Figures using the letter C schematically depict the interaction of components of the banding machine 100 with a tape roll 300, and with an object 200 to be banded by tape from the tape roll 300.
Figure 5B:
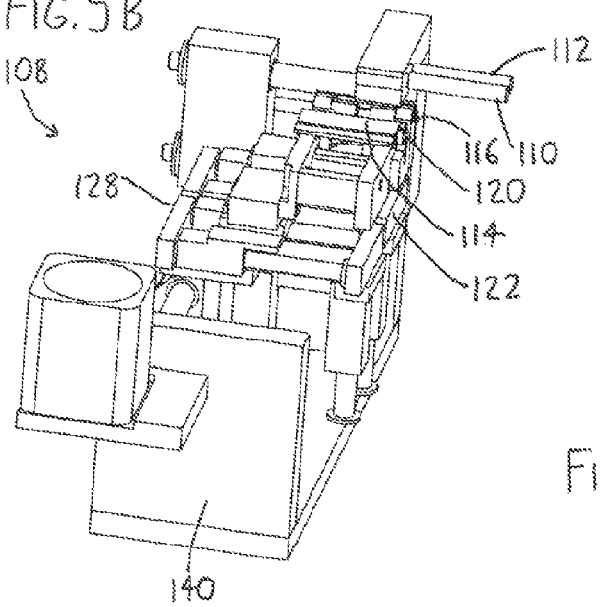
Figure 5C:
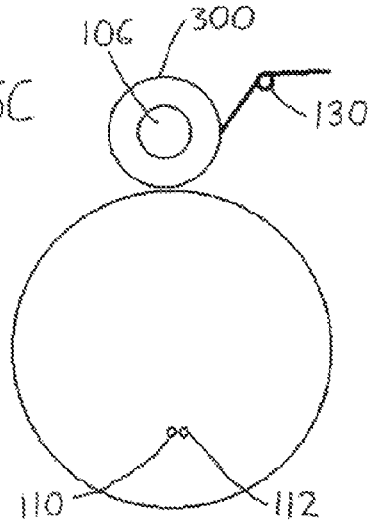
Figure 6A:
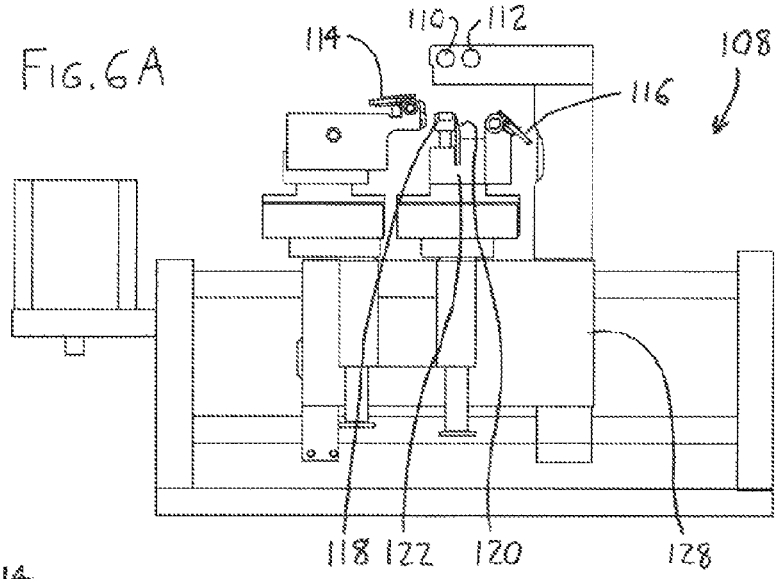
Figure 6B:
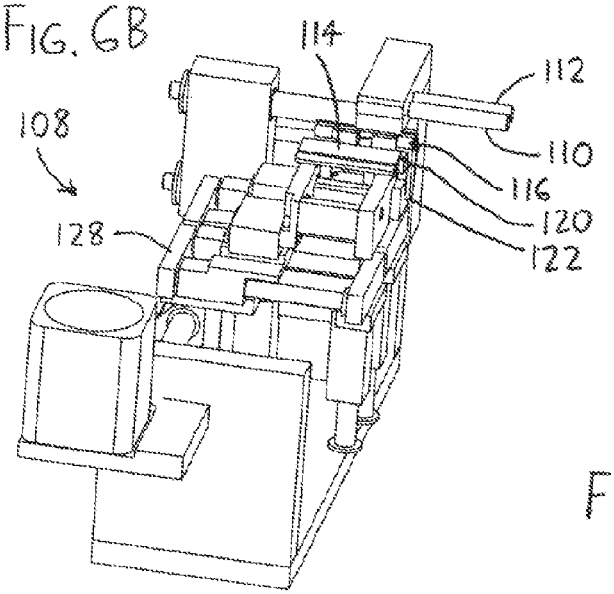
Figure 6C:
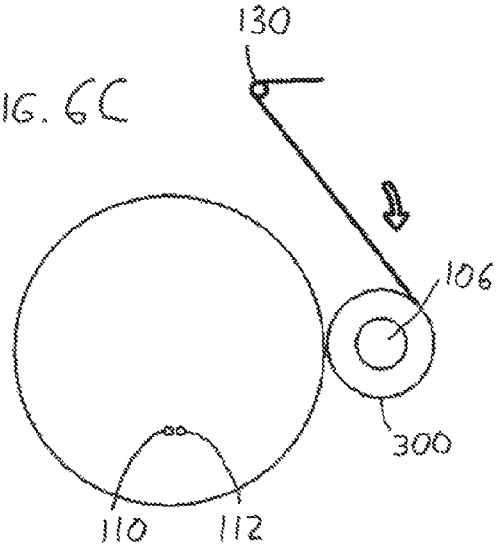
Figure 7A:
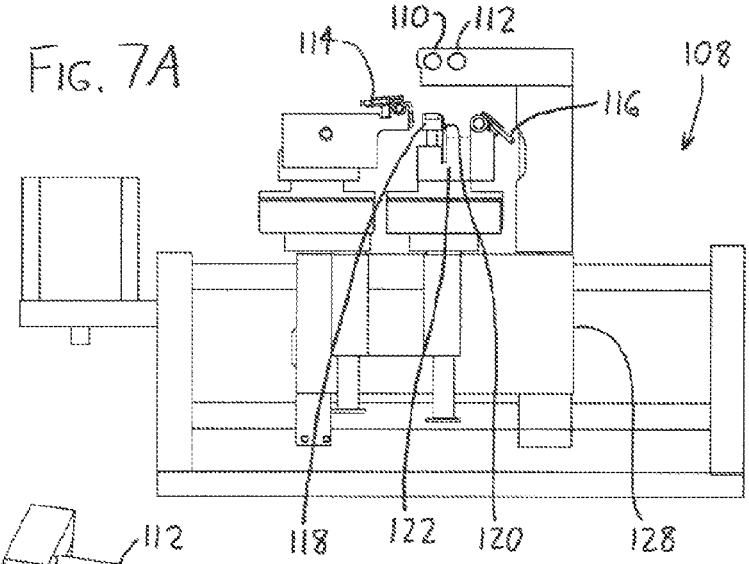
Figure 7B:
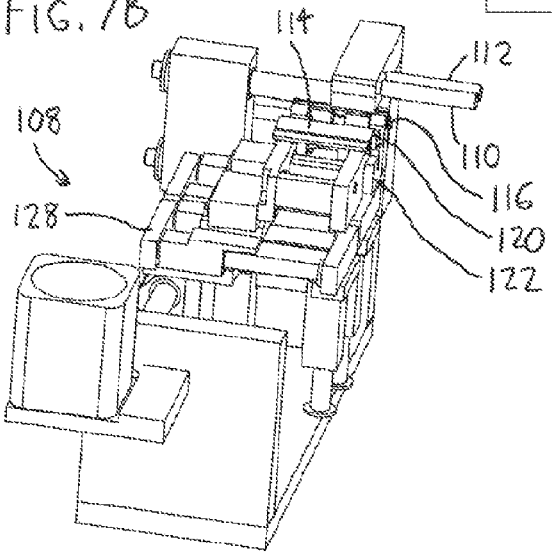
Figure 7C:
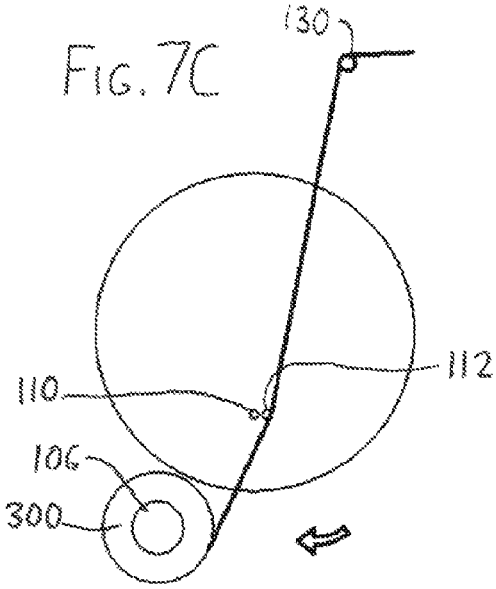
Figure 8A:
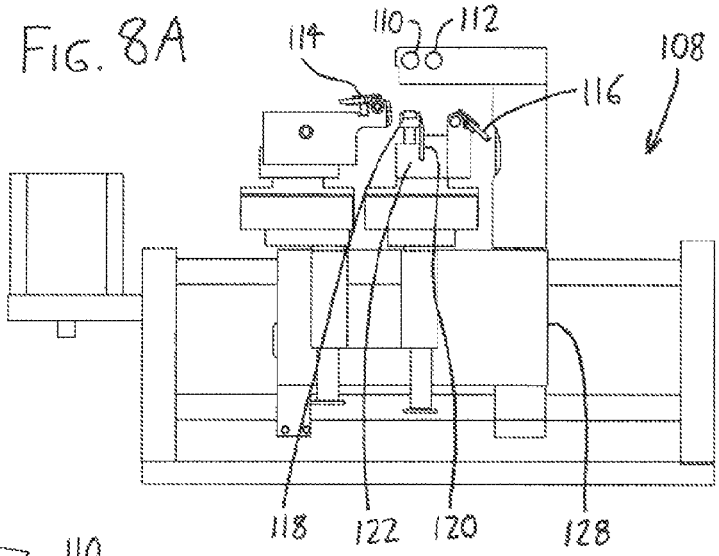
Figure 8B:
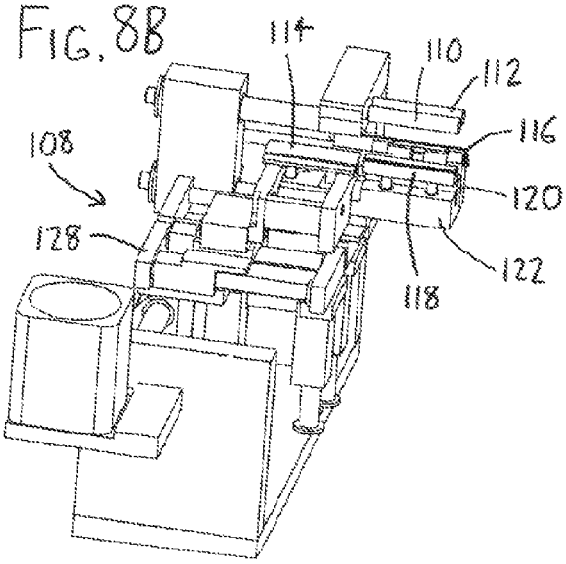
Figure 8C:
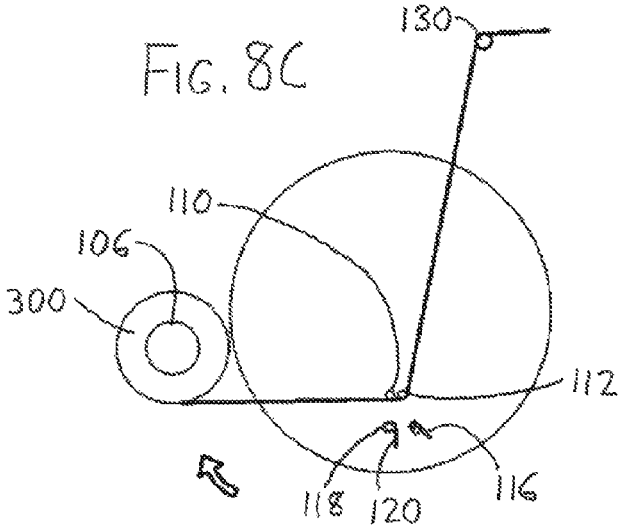
Figure 9A:
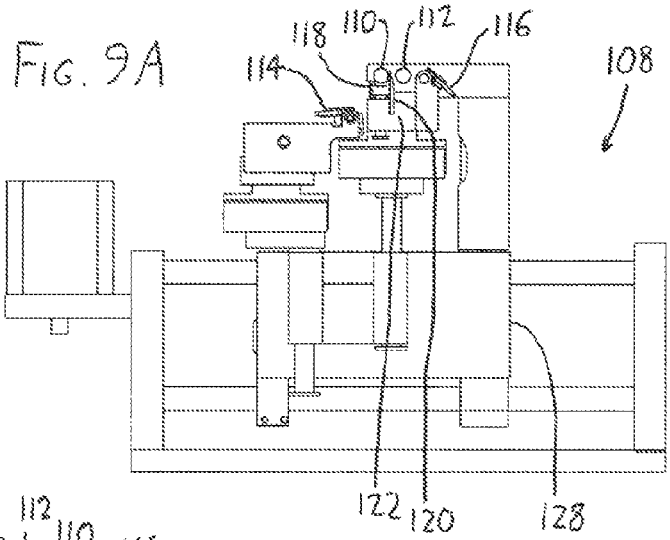
Figure 9B:
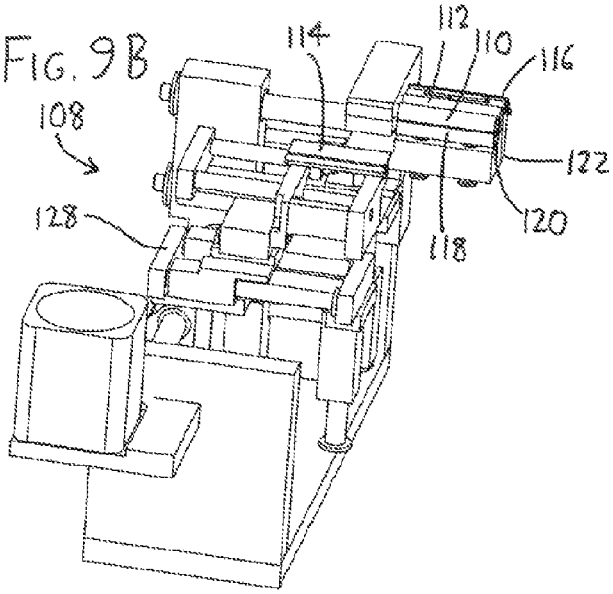
Figure 9C:
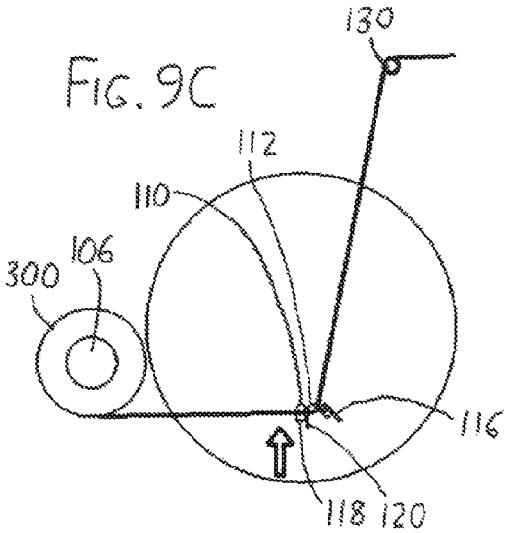
Figure 10A:
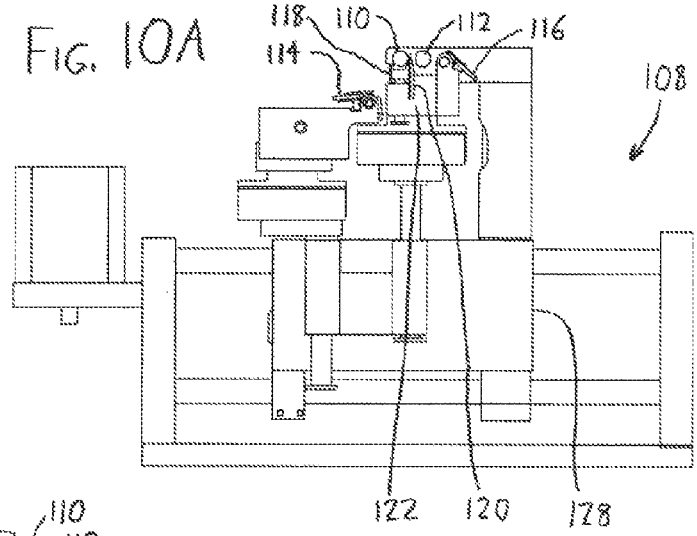
Figure 10B:
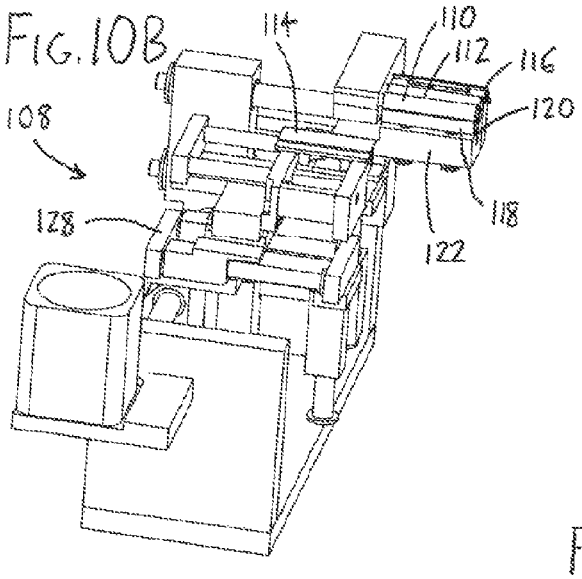
Figure 10C:
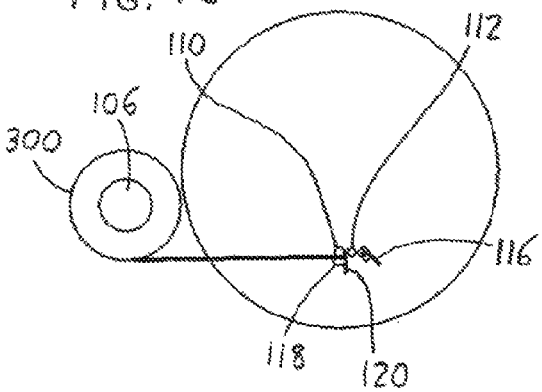
Figure 11A:
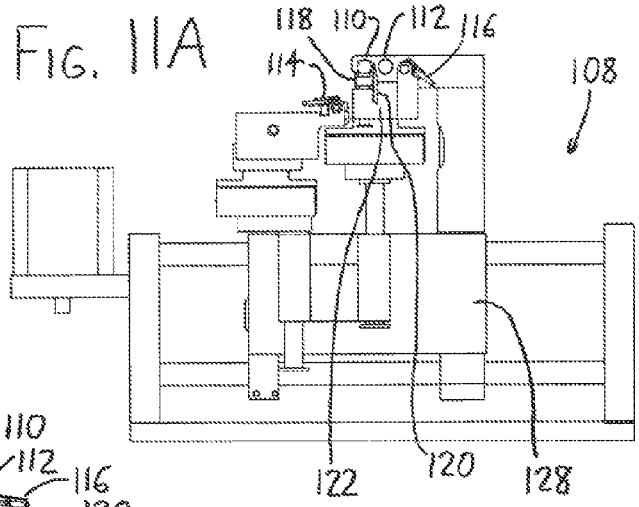
Figure 11B:
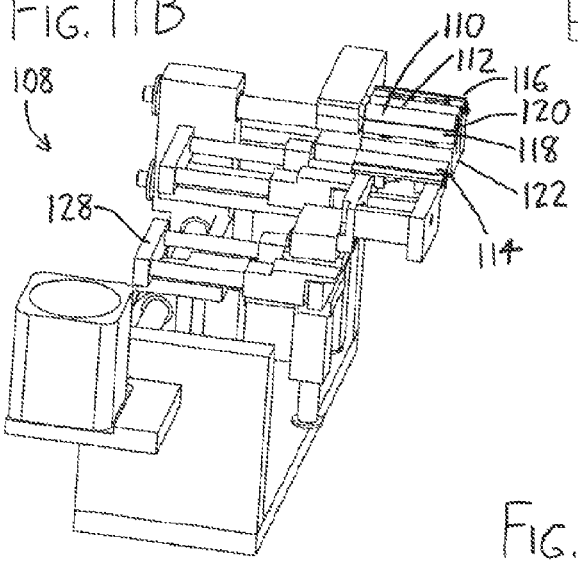
Figure 11C:
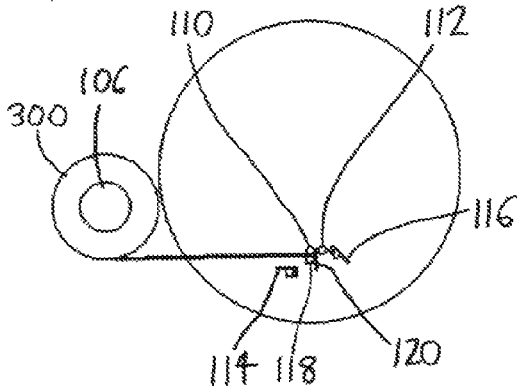

The banding machine preparation process of FIGS. 5-11 can be further characterized by the following summary of the positions/states of its components:

FIG. 5: Banding Machine Preparation—Load Tape
- Carriage 128: carriage starting position
- Subcarriage 122: out-of-plane state, withdrawn from cutting/wiping position
  - Brake 118: tape release position
  - Knife 120: non-cutting position
  - Second wiper 116: non-wiping position, unpivoted
- First wiper 114: out-of-plane state, in non-wiping position, unpivoted FIG. 6: Banding Machine Preparation—Tape Orbit Begins
- Carriage 128: carriage starting position
- Subcarriage 122: out-of-plane state, withdrawn from cutting/wiping position
  - Brake 118: tape release position
  - Knife 120: non-cutting position
  - Second wiper 116: non-wiping position, unpivoted
- First wiper 114: out-of-plane state, in non-wiping position, unpivoted FIG. 7: Banding Machine Preparation—Tape Wraps Rollers 110 and 112
- Carriage 128: carriage starting position
- Subcarriage 122: out-of-plane state, withdrawn from cutting/wiping position
- Brake 118: tape release position
- Knife 120: non-cutting position
- Second wiper 116: non-wiping position, unpivoted
- First wiper 114: out-of-plane state, in non-wiping position, unpivoted FIG. 8: Banding Machine Preparation—Prepare for Tape Grasp/Cut
- Carriage 128: carriage starting position
- Subcarriage 122: in-plane state, withdrawn from cutting/wiping position
  - Brake 118: tape release position
  - Knife 120: non-cutting position
  - Second wiper 116: non-wiping position, unpivoted
- First wiper 114: out-of-plane state, in non-wiping position, unpivoted FIG. 9: Banding Machine Preparation—Tape Grasp/Cut
- Carriage 128: carriage starting position
- Subcarriage 122: in-plane state, in cutting/wiping position
  - Brake 118: tape grasping position
  - Knife 120: cutting position
  - Second wiper 116: wiping position, unpivoted
- First wiper 114: out-of-plane state, in non-wiping position, unpivoted FIG. 10: Banding Machine Preparation—Scrap Tape Removal
- Carriage 128: carriage starting position
- Subcarriage 122: in-plane state, in cutting/wiping position
- Brake 118: tape grasping position
- Knife 120: cutting position
- Second wiper 116: wiping position, unpivoted
- First wiper 114: out-of-plane state, in non-wiping position, unpivoted FIG. 11: Banding Machine Preparation—Insert First Wiper 114
- Carriage 128: carriage starting position
- Subcarriage 122: in-plane state, in cutting/wiping position
  - Brake 118: tape grasping position
  - Knife 120: cutting position
  - Second wiper 116: wiping position, unpivoted
- First Wiper 114: In-Plane State, in Non-Wiping Position, Unpivoted It should be understood that the banding machine preparation process can vary the states/positions of various components from those described above. For example, during the preparation process, the first and second wipers 114 and 116 are not used, and the second wiper 116 is only translated into the orbital plane along with the brake 118 and knife 120 because the exemplary version of the banding machine 100 provides all of the brake 118, knife 120, and second wiper 116 on the subcarriage 122, such that the brake 118, knife 120, and second wiper 116 translate as a unit. However, the banding machine 100 need not include the subcarriage 122, and the brake 118, knife 120, and second wiper 116 may be configured to move independently of each other, in which case the second wiper 116 need not be translated into the orbital plane until FIG. 11 (or can otherwise be placed in the in-plane state only when needed during subsequent banding of an object 200). Similarly, the first wiper 114 could be placed in the in-plane state (as in FIG. 11) in FIG. 8 or thereafter, or could instead be placed in the in-plane state only when needed during subsequent banding of an object 200.

Figure 12A:
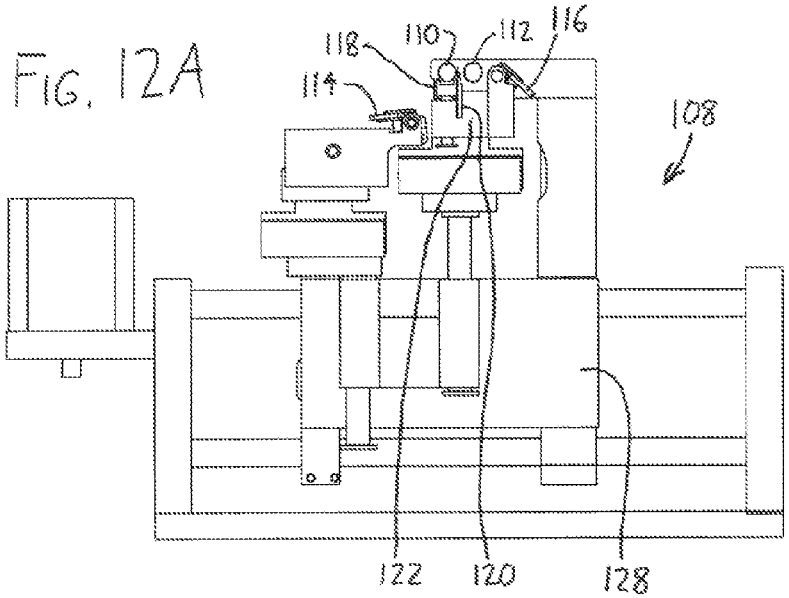
Figure 12B:
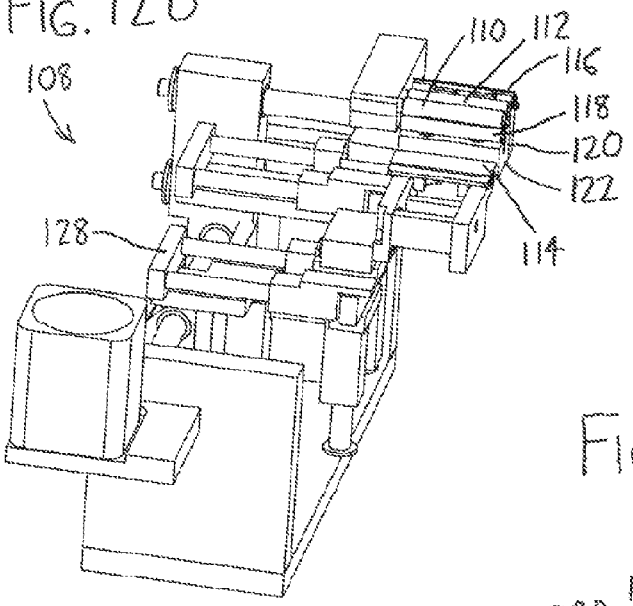
Figure 12C:
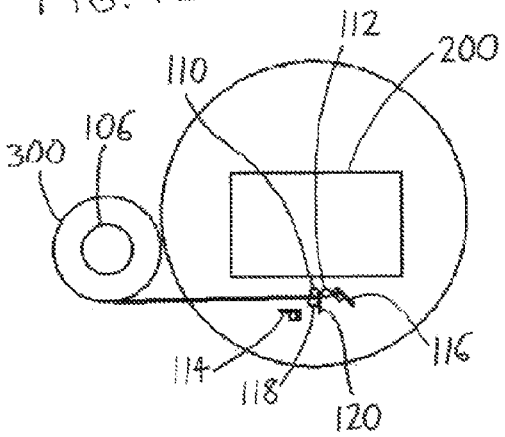
Figure 13A:
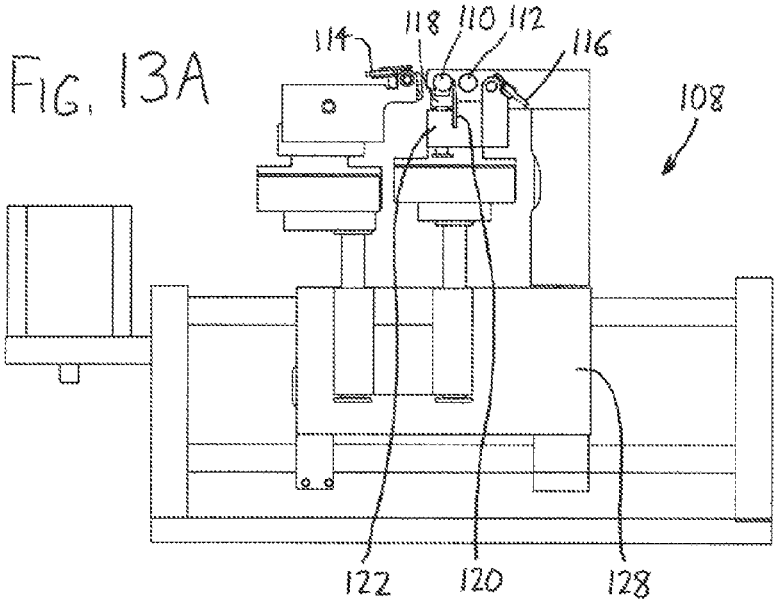
Figure 13B:
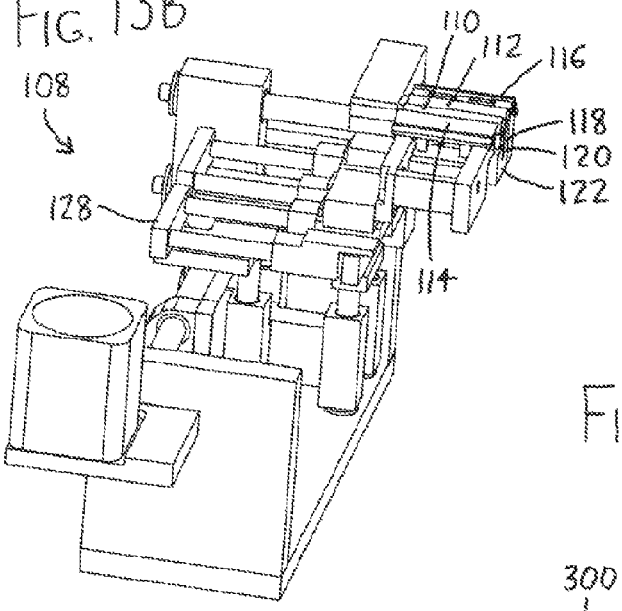
Figure 13C:
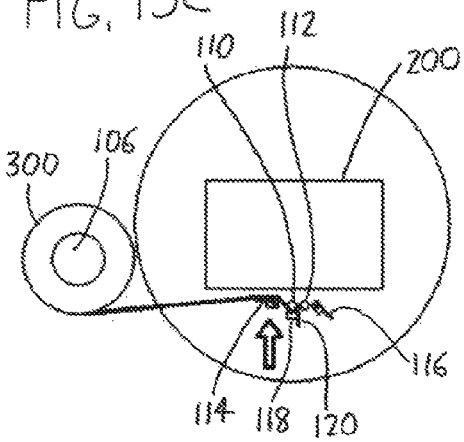
Figure 14A:
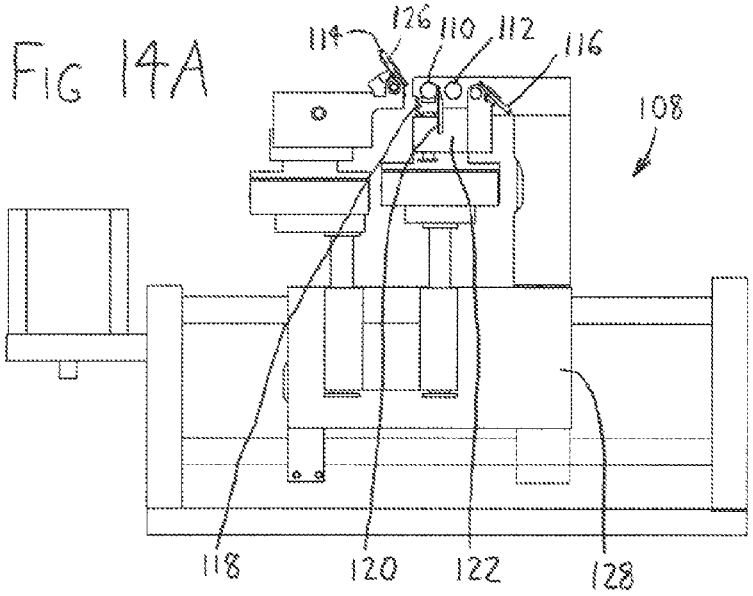
Figure 14B:
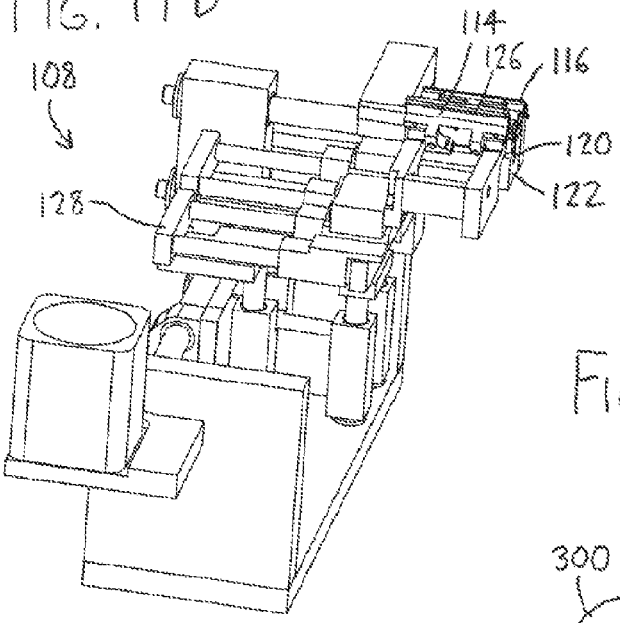
Figure 14C:
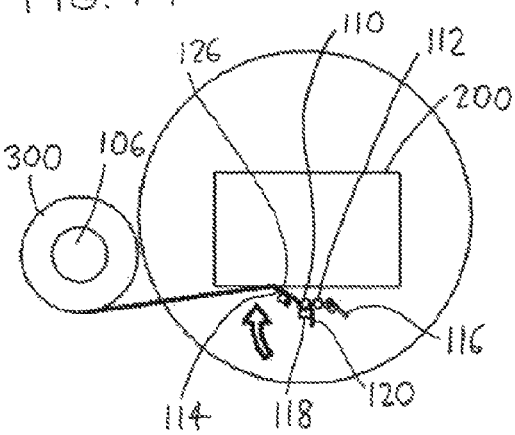
Figure 15A:
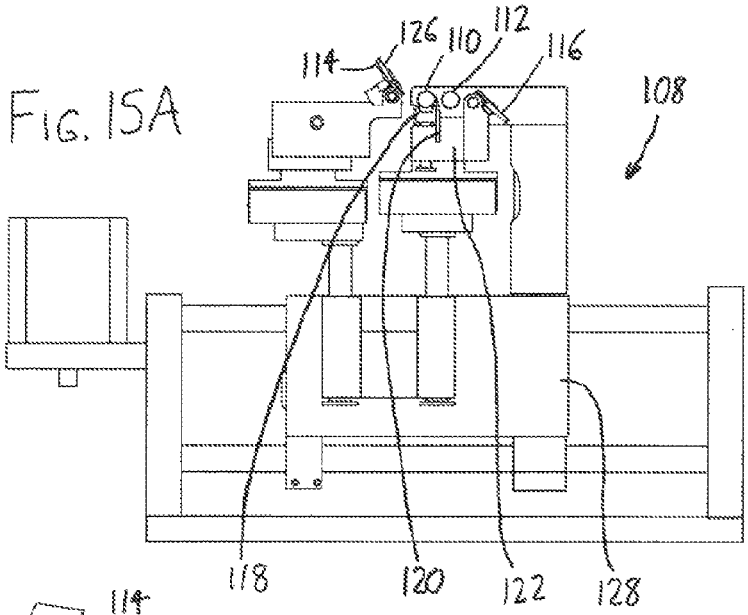
Figure 15B:
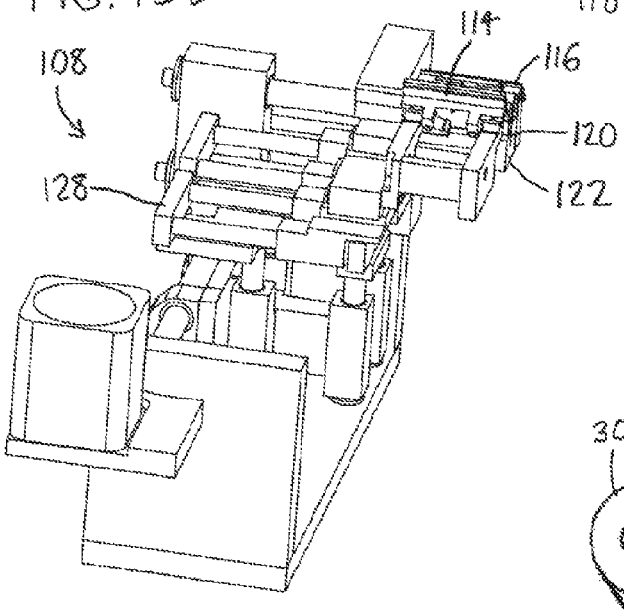
Figure 15C:
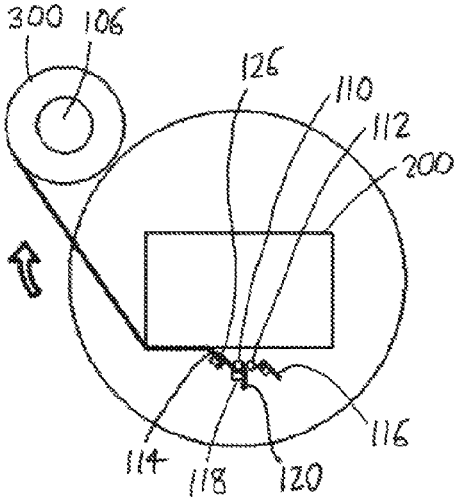

The object banding process of FIGS. 12-29 can be further characterized by the following summary of the positions/states of its components:

FIG. 12: Object Banding—Place Object 200 within Orbit
- Carriage 128: carriage starting position
- Subcarriage 122: in-plane state, in cutting/wiping position
  - Brake 118: tape grasping position
  - Knife 120: cutting position
  - Second wiper 116: wiping position, unpivoted
- First wiper 114: in-plane state, in non-wiping position, unpivoted FIG. 13: Object Banding—Prepare to Apply Tape Starting End to Object 200
- Carriage 128: carriage starting position
- Subcarriage 122: in-plane state, in cutting/wiping position
  - Brake 118: tape grasping position
  - Knife 120: cutting position
  - Second wiper 116: wiping position, unpivoted
- First wiper 114: in-plane state, in wiping position, unpivoted FIG. 14: Object Banding—Apply Tape Starting End to Object 200
- Carriage 128: carriage starting position
- Subcarriage 122: in-plane state, in cutting/wiping position
  - Brake 118: tape grasping position
  - Knife 120: cutting position
  - Second wiper 116: wiping position, unpivoted
- First wiper 114: in-plane state, in wiping position, pivoted FIG. 15: Object Banding—Begin Applying Tape to Object 200

Figure 16A:
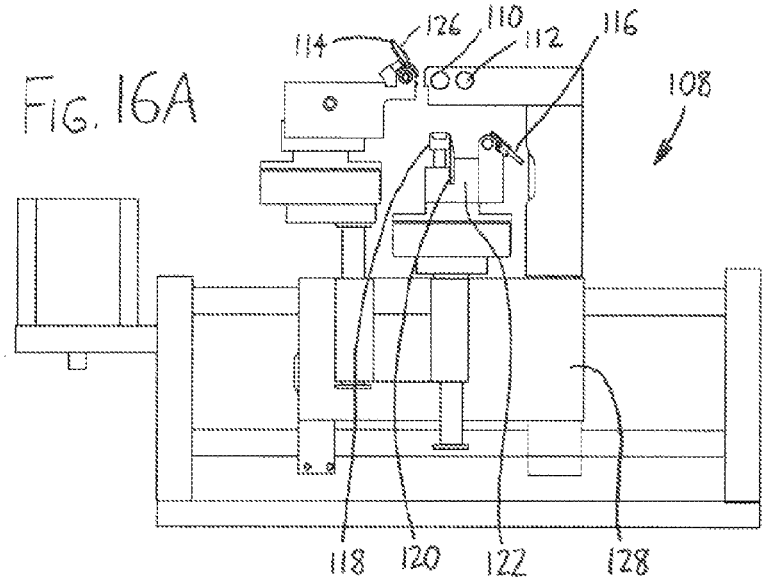
Figure 16B:
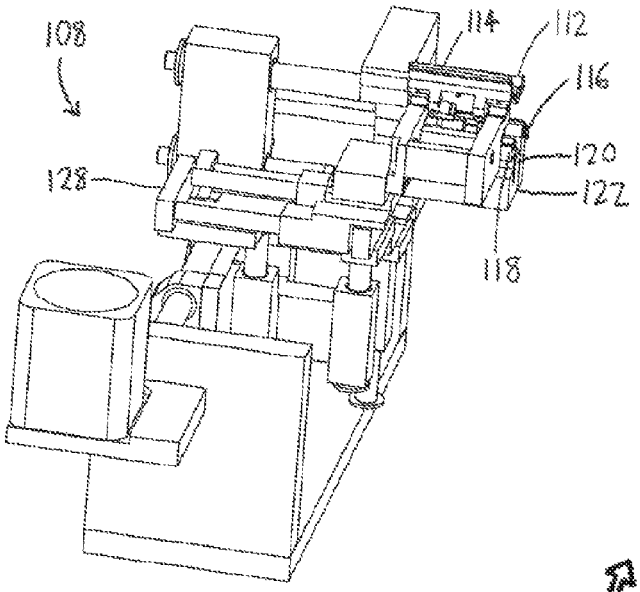
Figure 16C:
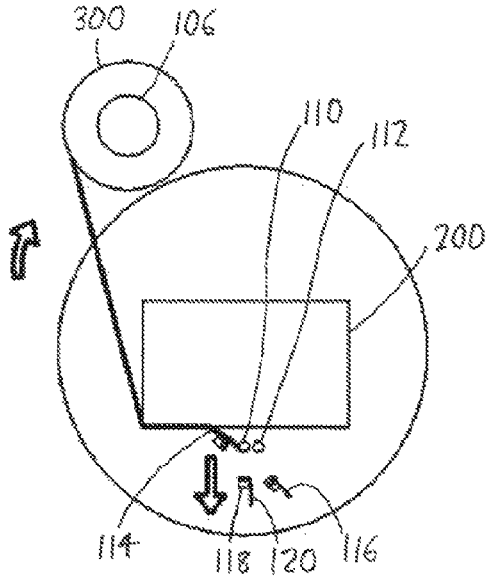
Figure 17A:
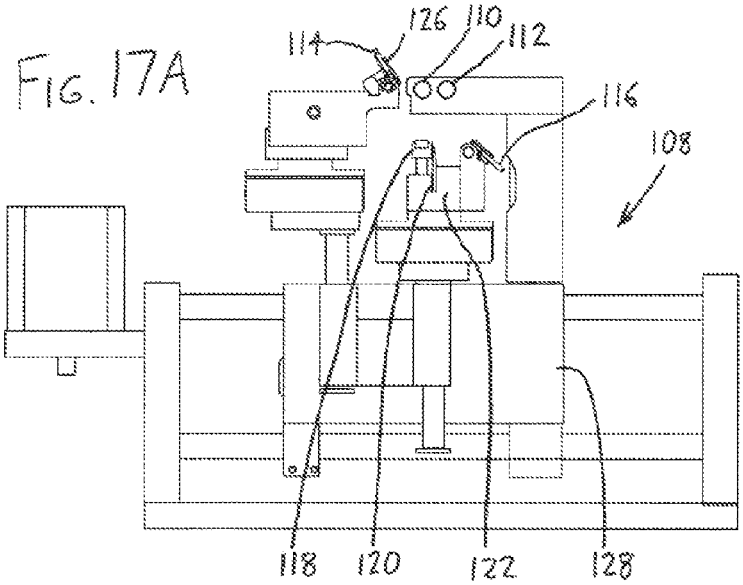
Figure 17B:
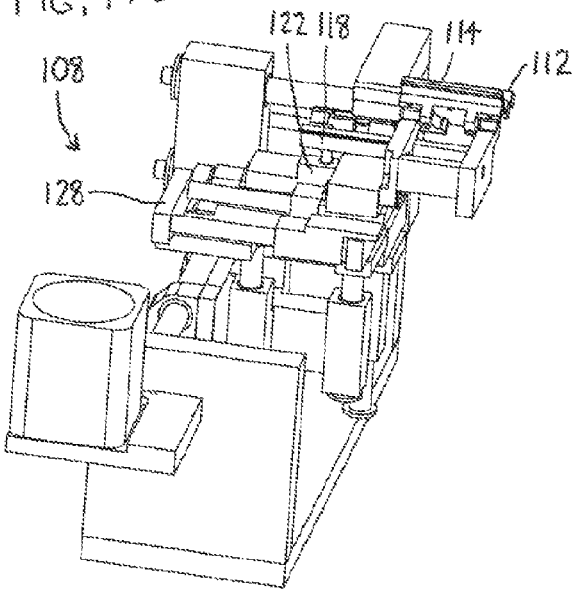
Figure 17C:
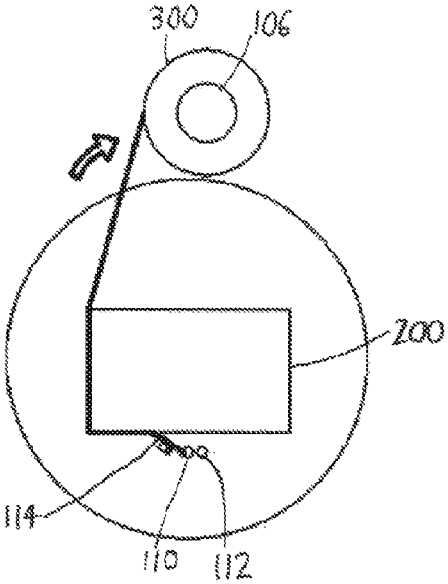

Carriage 128: carriage starting position
Subcarriage 122: in-plane state, in cutting/wiping position
Brake 118: tape grasping position
Knife 120: cutting position
Second wiper 116: wiping position, unpivoted
First wiper 114: in-plane state, in wiping position, pivoted
FIG. 16: Object Banding—Release Tape Starting End
Carriage 128: carriage starting position
Subcarriage 122: in-plane state, withdrawn from cutting/wiping position
Brake 118: tape release position
Knife 120: non-cutting position
Second wiper 116: non-wiping position, unpivoted
First wiper 114: in-plane state, in wiping position, pivoted
FIG. 17: Object Banding—Move Subcarriage 122 from Orbit
Carriage 128: carriage starting position
Subcarriage 122: out-of-plane state, withdrawn from cutting/wiping position
Brake 118: tape release position
Knife 120: non-cutting position
Second wiper 116: non-wiping position, unpivoted
First wiper 114: in-plane state, in wiping position, pivoted
FIG. 18: Object Banding—Wipe Tape Starting End onto Object 200
Carriage 128: tape starting end wiping position
Subcarriage 122: out-of-plane state, withdrawn from cutting/wiping position
Brake 118: tape release position
Knife 120: non-cutting position
Second wiper 116: non-wiping position, unpivoted
First wiper 114: in-plane state, in wiping position, pivoted
FIG. 19: Object Banding—Begin Moving First Wiper 114 from Orbit
Carriage 128: tape starting end wiping position
Subcarriage 122: out-of-plane state, withdrawn from cutting/wiping position
Brake 118: tape release position
Knife 120: non-cutting position
Second wiper 116: non-wiping position, unpivoted
First wiper 114: in-plane state, in non-wiping position, unpivoted
FIG. 20: Object Banding—Move First Wiper 114 from Orbit
Carriage 128: tape starting end wiping position
Subcarriage 122: out-of-plane state, withdrawn from cutting/wiping position
Brake 118: tape release position
Knife 120: non-cutting position
Second wiper 116: non-wiping position, unpivoted
First wiper 114: out-of-plane state, in non-wiping position, unpivoted
FIG. 21: Object Banding—Move Rollers 110 and 112 to Desired Tape Finishing End Position
Carriage 128: assembly starting (or other) position
Subcarriage 122: out-of-plane state, withdrawn from cutting/wiping position
Brake 118: tape release position
Knife 120: non-cutting position
Second wiper 116: non-wiping position, unpivoted
First wiper 114: out-of-plane state, in non-wiping position, unpivoted
FIG. 22: Object Banding—Wrap Rollers 110 and 112 with Tape
Carriage 128: assembly starting (or other) position
Subcarriage 122: out-of-plane state, withdrawn from cutting/wiping position
Brake 118: tape release position
Knife 120: non-cutting position
Second wiper 116: non-wiping position, unpivoted
First wiper 114: out-of-plane state, in non-wiping position, unpivoted
FIG. 23: Object Banding—Prepare for Tape Cutting
Carriage 128: assembly starting (or other) position
Subcarriage 122: in-plane state, withdrawn from cutting/wiping position
Brake 118: tape release position
Knife 120: non-cutting position
Second wiper 116: non-wiping position, unpivoted
First wiper 114: out-of-plane state, in non-wiping position, unpivoted
FIG. 24: Object Banding—Cut Tape
Carriage 128: assembly starting (or other) position
Subcarriage 122: in-plane state, in cutting/wiping position
Brake 118: tape grasping position
Knife 120: cutting position
Second wiper 116: wiping position, unpivoted
First wiper 114: out-of-plane state, in non-wiping position, unpivoted
FIG. 25: Object Banding—Begin Wiping Tape Finishing End onto Object 200
Carriage 128: assembly starting (or other) position
Subcarriage 122: in-plane state, in cutting/wiping position
Brake 118: tape grasping position
Knife 120: cutting position
Second wiper 116: wiping position, pivoted
First wiper 114: out-of-plane state, in non-wiping position, unpivoted
FIG. 26: Object banding—Complete wiping tape finishing end onto object 200
Carriage 128: tape finishing end wiping position
Subcarriage 122: in-plane state, in cutting/wiping position
Brake 118: tape grasping position
Knife 120: cutting position
Second wiper 116: wiping position, pivoted
First wiper 114: out-of-plane state, in non-wiping position, unpivoted
FIG. 27: Object Banding—Remove Second Wiper 116 from Tape
Carriage 128: tape finishing end wiping position
Subcarriage 122: in-plane state, in cutting/wiping position
Brake 118: tape grasping position
Knife 120: cutting position
Second wiper 116: wiping position, unpivoted
First wiper 114: out-of-plane state, in non-wiping position, unpivoted
FIG. 28: Object Banding—Return Carriage 128 to Carriage Starting Position
Carriage 128: carriage starting position
Subcarriage 122: in-plane state, in cutting/wiping position
Brake 118: tape grasping position
Knife 120: cutting position
Second wiper 116: wiping position, unpivoted
First wiper 114: out-of-plane state, in non-wiping position, unpivoted
FIG. 29: Object Banding—Return Carriage 128 to Starting Condition
Carriage 128: carriage starting position
Subcarriage 122: in-plane state, in cutting/wiping position
Brake 118: tape grasping position
Knife 120: cutting position
Second wiper 116: wiping position, unpivoted
First wiper 114: in-plane state, in non-wiping position, unpivoted As with the banding machine preparation process, the object banding process can vary the states/positions of various components from those described above. For example, the subcarriage 122 (the brake 118, knife 120, and second wiper 116) need not immediately be withdrawn to the out-of-plane state following FIG. 16, and could instead be withdrawn prior to FIG. 22 (for example, the subcarriage 122 might be withdrawn along with the first wiper 114 following FIG. 19). It should therefore be understood that throughout this document, the described steps of the processes can be performed in orders other than those described above.

The banding process shown in the drawings applies a band wherein the tape finishing end is roughly aligned with the tape starting end (see, for example, FIGS. 26C-29C). The banding process may be adapted to overlap the tape finishing end over the tape starting end in a band, or conversely to space the tape finishing end from the tape stating end in a (partial) band, by moving the rollers 110 and 112 (and more generally the carriage 128) to the desired location of the tape finishing end along the product prior to cutting the tape and forming the tape finishing end (for example, in FIG. 21). The carriage 128 is thereafter moved back to the starting position (for example, in FIG. 28), which is also preferably set by the user at a desired location corresponding to where banding is to begin on an object 200.

As described above, the banding process applies bands which have only a single layer (a single orbit) of tape, but multiple layers are possible by simply withdrawing the rollers 110 and 112 from the orbital plane during the first orbit (for example, in FIG. 20), applying as many zo successive layers/orbits as desired, and then reintroducing the rollers 110 and 112 (as in FIG. 20) during the final orbit. The controls of the banding machine 100 of FIG. 1 are preferably configured such that a user can enter the desired number of layers, whereby the banding machine 100 will then apply that many layers to each banded object 200 until the user specifies a different number of layers are desired.

While the foregoing discussion describes applying a band about a single object 200, it should be understood that multiple objects can be banded together; for example, the object 200 shown in the drawings may instead be multiple objects arrayed side-by-side. The same processes may be applied to single or multiple objects.

Figure 30:
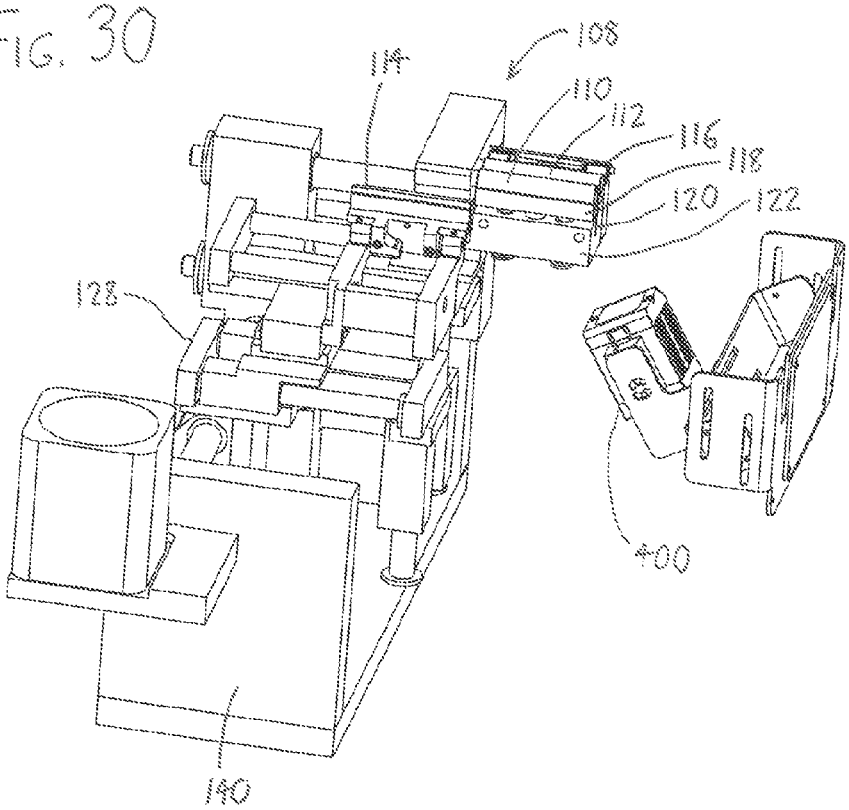
FIG. 30 is an isometric view of a camera 400, as it may be situated in relation to the tape handling assembly 108 within the banding machine 100 when optical imaging is used to situate printed tape in a desired manner on an object being tape-banded by the banding machine 100.

The invention accommodates the use of printable or pre-printed tape (in particular, tape having a printable or pre-printed side opposite its adhesive side, though printing may also or alternatively be present on the adhesive side). Where pre-printed tape is used, so long as the tape bears a regularly-situated registration mark or other regularly-situated optically-recognizable indicia, the invention can apply tape bands to objects in such a manner that uniform objects are uniformly banded (that is, the printing on the applied bands is similarly situated on all banded objects). To do so, the invention can incorporate an optical recognition system which locates the registration mark (or other indicia) on the tape (e.g., in FIG. 11), and/or on each prior banded object 200, and can move the carriage 128 to a starting position so that the tape is applied to the object 200 with the printed matter in the desired location. An example of such an arrangement is shown in FIG. 30, showing a camera 400 as it might be situated within the housing 132 of the banding machine 120, such that it images the tape applied to the object 200 (FIG. 2) through the table slot 104 (FIG. 1).

As the banding machines and methods described above expand on concepts described in U.S. Pat. No. 8,365,508, the reader is directed to that patent for any features which are not described herein. It should be understood that the invention can incorporate any of the features described in that patent.

Throughout this document, terms such as "leftward", "rightward", "below," "above," forward", "rearward", "upwardly", "downwardly", and the like are relative terms, and are not to be construed as absolute. In other words, it should be understood (for example) that where the first wiper 114 is described as being situated leftward from the rollers 110 and 112, this is the relationship when viewed from (for example) FIG. 3, and the first wiper 114 may instead be regarded as situated rightward from the rollers 110 and 112 if viewed from the opposite side of the tape handling assembly 108. Thus, such terms should be regarded as words of convenience, rather than limiting terms. It is noted that banding need not occur in the orientation shown in the drawings, that is, banding need not occur in a vertically-oriented orbital plane, nor need it occur about an object 200 resting on a horizontal table 102 (nor does a table 102 even need to be present, though a table 102 is useful to help hold the object 200 steady during banding as the object 200 is subjected to the force of tape application). The spool 106 may orbit any object 200, whether having a box-like configuration as shown in the drawings or otherwise, in an orbital plane having any orientation, with a starting position for the carriage 128 selected within the orbit as desired.

Also throughout this document, where a measurement or other value is qualified by the term "approximately" (or a like term such as "generally," "roughly," "around," or "about"), this can be regarded as referring to a variation of 30% from the noted value (that is, ranging from 30% below the noted value to 30% above the noted value, and including the noted value). Thus, as an example, "approximately parallel" and "approximately perpendicular" can respectively be understood to mean within 27 degrees (i.e., 30% of 90 degrees) from parallel and perpendicular. Where a qualifying term such as "substantially," "essentially," "almost," or "nearly" is used, this can be regarded as referring to a variation of 10% from the noted value (that is, ranging from 10% below the noted value to 10% above the noted value, and including the noted value).

Also throughout this document, where an item is said to be "movable" in a certain manner, this should be construed as meaning that the item is configured to move in the noted manner during ordinary operation of the banding machine 100.

The versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A banding machine including:

a. a rotatable spool configured to travel along an orbital path, the rotatable spool being configured to bear a roll of tape thereon, b. a tape handling assembly including:

(1) a rotatable first roller, the first roller being:

(a) situated along a chord of, and (b) spaced from, the orbital path, (2) a first wiper movable toward and away from a first wiper wiping position at which the first wiper is configured to urge against an object to be banded by tape, the first wiper wiping position being:

(a) situated along the chord, and
(b) laterally spaced from the first roller in a first direction, (3) a second wiper movable toward and away from a second wiper wiping position at which the second wiper is configured to urge against the object to be banded by tape, the second wiper wiping position being:
(a) situated along the chord, and
(b) laterally spaced from the first roller in a second direction opposite the first direction, (4) a brake movable within the plane of the orbital path:
(a) toward the first roller, whereby tape may be grasped between the brake and the first roller, and
(b) away from the first roller, (5) a knife movable within the plane of the orbital path toward and away from a cutting space:
(a) situated along the chord, and
(b) adjacent the first roller, wherein the tape handling assembly is configured to move as a unit within the banding machine.

2. The banding machine of claim 1 wherein each of the first and second wipers has a wiper surface pivotable toward the chord.

3. The banding machine of claim 1 wherein:
a. the tape handling assembly further includes a rotatable second roller spaced from the first roller, the first and second rollers being situated along the chord,
b. the first wiper wiping position is laterally spaced from the rollers in the first direction,
c. the second wiper wiping position is laterally spaced from the rollers in the second direction,
d. the cutting space is between the first and second rollers.

4. The banding machine of claim 3 wherein:
a. each of the first and second wipers has a wiper surface pivotable toward the chord, and
b. each of the wiper surfaces extends from a pivot axis, wherein at least a major portion of each wiper's wiper surface is spaced further from the roller closest to the wiper than from the pivot axis.

5. The banding machine of claim 1 wherein the brake is configured to resiliently yield to an opposing force, whereby the brake ceases motion if moved onto the first roller.

6. The banding machine of claim 1 wherein the brake is movable toward and away from the first roller along a brake path oriented at least approximately perpendicular to the chord of the orbital path.

7. The banding machine of claim 1 wherein the brake and knife move as a unit:
a. within the plane of the orbital path, and/or
b. into and out of the plane of the orbital path.

8. The banding machine of claim 7 wherein:
a. the second wiper moves as a unit with the brake and knife, and
b. the first wiper moves:
(1) within the plane of the orbital path, and/or
(2) into and out of the plane of the orbital path,
independently of the brake, knife, and second wiper.

9. The banding machine of claim 1 wherein the tape handling assembly is movable as a unit in a direction approximately parallel to the chord.

10. A process of using the banding machine of claim 1 including the step of: traveling the spool along the orbital path with:
a. the spool bearing the roll of tape thereon, the roll of tape being defined by tape having an adhesive side, the tape being rolled to form the roll of tape,
b. the tape unspooling from the roll of tape during travel to wrap about the first roller, and
c. the adhesive side of the tape contacting the first roller.

11. A process of using the banding machine of claim 1 including the steps of:
a. traveling the spool along the orbital path with:
(1) the spool bearing a roll of tape thereon, the roll of tape being defined by tape having a printed side, the tape being rolled to form the roll of tape,
(2) the tape unspooling from the roll of tape during travel to wrap about an object,
b. obtaining an image of the printed side of the tape, and
c. moving the tape handling assembly as a unit:
(1) in a direction approximately parallel to the chord, and
(2) in dependence on the obtained image of the printed side of the tape.

12. A process of using the banding machine of claim 1, the process including the steps of:
a. traveling the spool along the orbital path with:
(1) the spool bearing a roll of tape thereon, and
(2) an end of the tape being maintained in a fixed position,
whereby the tape unspools from the roll during travel to wrap about the first roller,
b. moving the brake within the plane of the orbital path toward the first roller, whereby the tape is grasped between the brake and the first roller,
c. moving the knife within the plane of the orbital path toward the cutting space, thereby cutting the tape between the first and second rollers.

13. The process of claim 12:
a. wherein during travel of the spool along the orbital path, the end of the tape is maintained in the fixed position outside the orbital path, and
b. further including the step of removing a length of tape between the brake and the tape end.

14. The process of claim 12:
a. placing the object within the orbital path, wherein the first and second rollers are situated between the object and the orbital path,
b. wherein during travel of the spool along the orbital path:
(1) the end of the tape is maintained in the fixed position on the object, and
(2) the tape unspools from the roll during travel to wrap about the object prior to wrapping about the first roller.

15. The process of claim 14:
a. further including the step of moving the second wiper toward the second wiper wiping position,
b. following the step of moving the knife toward the cutting space, urging the second wiper against the object, with the tape wrapped about the object being situated between the second wiper and the object.

16. The process of claim 15 further including the step of moving the second wiper along the object, with the tape wrapped about the object being situated between the second wiper and the object.

17. A process of using the banding machine of claim 3, the process including the steps of:
a. placing the object within the orbital path, wherein the first and second rollers are situated between the object and the orbital path, b. moving the first wiper toward the first wiper wiping position to urge the first wiper against the object, with:
(1) the spool bearing the roll of tape thereon,
(2) a starting end of the tape being maintained between the brake and the first roller, and
(3) a portion of the tape between the tape starting end and the roll being situated between the first wiper and the object, c. traveling the spool along the orbital path, whereby the tape unspools from the roll during travel to wrap about the object, d. moving the brake within the plane of the orbital path away from the first roller, thereby releasing the tape starting end, e. after the tape has unspooled from the roll to wrap about the object and the first and second rollers, moving the brake within the plane of the orbital path toward the first roller, whereby the tape is grasped between the brake and the first roller, f. moving the knife within the plane of the orbital path toward the cutting space, thereby:
(1) cutting the tape between the first and second rollers, and
(2) defining a finishing end of the tape extending from the object.

18. The process of claim 17 further including the steps of
a. moving the first wiper along the object toward the tape starting end, and
b. moving the first wiper out of the plane of the orbital path, following the step of moving the brake within the plane of the orbital path away from the first roller.

19. The process of claim 17 further including the step of moving the second wiper toward the second wiper wiping position to urge the second wiper against the object, with the tape finishing end being situated between the second wiper and the object.

20. The process of claim 17 further including the step of moving the first and second rollers out of the plane of the orbital path prior to halting travel of the spool along the orbital path.

21. The banding machine of claim 1 wherein the first roller is movable within the plane of the orbital path.

22. The banding machine of claim 1 wherein the first roller is movable into and out of the plane of the orbital path.

23. The banding machine of claim 1 wherein the tape handling assembly is movable within the plane of the orbital path.

24. A banding machine including:
a. a rotatable spool configured to travel along an orbital path, the rotatable spool being configured to bear a roll of tape thereon,
b. a tape handling assembly including:
(1) a rotatable first roller, the first roller being:
(a) situated along a chord of, and
(b) spaced from,
the orbital path,
(2) a first wiper movable toward and away from a first wiper wiping position at which the first wiper is configured to urge against an object to be banded by tape, the first wiper wiping position being:
(a) situated along the chord, and
(b) spaced from the first roller in a first direction,
(3) a second wiper movable toward and away from a second wiper wiping position at which the second wiper is configured to urge against an object to be banded by tape, the second wiper wiping position being:
(a) situated along the chord, and
(b) spaced from the first roller in a second direction opposite the first direction,
(4) a brake movable within the plane of the orbital path:
(a) toward the first roller, whereby tape may be grasped between the brake and the first roller, and
(b) away from the first roller,
(5) a knife movable within the plane of the orbital path toward and away from a cutting space situated along the chord, wherein the tape handling assembly is configured to move as a unit into and out of the plane of the orbital path.

* * * * *